US006616777B1

(12) United States Patent
Tsuchiya et al.

(10) Patent No.: US 6,616,777 B1
(45) Date of Patent: Sep. 9, 2003

(54) FE ALLOY MATERIAL FOR THIXOCASTING AND METHOD FOR HEATING THE SAME

(75) Inventors: Masayuki Tsuchiya, Wako (JP); Hiroaki Ueno, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/508,458

(22) PCT Filed: Jul. 14, 1999

(86) PCT No.: PCT/JP99/03794

§ 371 (c)(1),
(2), (4) Date: Mar. 10, 2000

(87) PCT Pub. No.: WO00/04198

PCT Pub. Date: Jan. 27, 2000

(30) Foreign Application Priority Data

| | | |
|---|---|---|
| Jul. 14, 1998 | (JP) | 10-214828 |
| Sep. 8, 1998 | (JP) | 10-253750 |
| Nov. 12, 1998 | (JP) | 10-322565 |

(51) Int. Cl.[7] ..... C22C 37/00; B22D 17/00
(52) U.S. Cl. ..... 148/321; 148/320
(58) Field of Search ..... 148/320, 321

(56) References Cited

U.S. PATENT DOCUMENTS

| | | | | |
|---|---|---|---|---|
| 4,345,943 A | * | 8/1982 | Takahashi et al. | 75/238 |
| 6,136,101 A | * | 10/2000 | Sugawara et al. | 148/321 |

FOREIGN PATENT DOCUMENTS

| | | | |
|---|---|---|---|
| EP | 0 864 662 | | 9/1998 |
| EP | 0 864 662 A1 | | 9/1998 |
| JP | 5-43978 | | 2/1993 |
| JP | 6-106321 | | 4/1994 |
| JP | 10068041 | * | 3/1998 |
| JP | 10-152745 | | 6/1998 |
| JP | 10-195586 | | 7/1998 |
| JP | 11-50140 | | 2/1999 |
| WO | WO 98/10111 | | 3/1998 |
| WO | 98/10111 | * | 3/1998 |

OTHER PUBLICATIONS

"Ubersicht über die Sorten der verschleißfesten weißen Guβeisen", *GIESEREI–PRAXIS*, pp. 8–11, Jan. 1973.
Frick et al.; "Untersuchung über die Wirkung von Legierungs–elementen im weißen Guβeisen (Hartguβ)", *GIESEREI–PRAXIS*, p. 183. Jan. 1973.
"Neue Erkenntnisse in der Metallurgie des Guβeisens", *GIESEREI–PRAXIS*, pp. 309–310; Aug. 1958.
"Der Einfluβ des Kohlenstoffs", p. 235.
"Titan"; *GIESEREI–PRAXIS*, p. 161; Sep. 1971.
"ZEITSCHRIFTENSCHAU", *Gieβereitechnik*; p. 283; Sep. 1980.

(List continued on next page.)

*Primary Examiner*—Sikyin Ip
(74) *Attorney, Agent, or Firm*—Armstrong, Westerman & Hattori, LLP

(57) ABSTRACT

A thixocast Fe-based alloy material is provided, from which a cast product having mechanical properties uniform over the whole thereof can be produced.

The Fe-based alloy material comprises 1.8% by weight≦C≦2.5% by weight, 1.0% by weight≦Si≦3.0% by weight, 0.1% by weight≦Mn≦1.5% by weight, 0.5% by weight≦Ni≦3.0% by weight, and as the balance, iron (Fe) including inevitable impurities. The eutectic crystal amount Ec is in a range of 10% by weight<Ec<50% by weight.

4 Claims, 25 Drawing Sheets

OTHER PUBLICATIONS

Translation of "Ubersicht über die Sorten der verschleißfesten weißen Guβeisen" ("Overview of the types of wear–resistant white cast iron"), *GIESEREI–PRAXIS*, pp. 8–11; Jan. 1973.

Translation of Frick et al.; "Untersuchung über die Wirkung von Legierungs–elementen im weißen Guβeisen (Hartguβ)" ("An Investigation of the effect of alloying elements in white cast iron (hard cast iron)"), *GIESERAI–PRAXIS*, p. 183; Jan. 1973.

Translation of "Neue Erkenntnisse in der Metallurgie des Guβeisens" ("New discoveries in the metallurgy of cast iron"), *GIESEREI–PRAXIS*, pp. 309–310; Aug. 1958.

Translation of "Der Einfluβ des Kohlenstoffs" ("Is there a lower limit for the carbon content of high–quality cast iron (grey cast iron)?"), p. 235.

Translation of "Titan" ("Titanium"); *GIESEREI–PRAXIS*, p. 161; Sep. 1971.

Translation of "ZEITSCHRIFTENSCHAU" ("Journal Summary"), *Gieβereitechnik*; p. 283; Sep. 1980.

* cited by examiner

BASE END PORTION B3 OF EXAMPLE (1) OF CAST PRODUCT

100μm

INTERMEDIATE PORTION B2 OF EXAMPLE (1) OF CAST PRODUCT

100μm

TIP END PORTION B1 OF EXAMPLE (1) OF CAST PRODUCT

100μm

BASE END PORTION B3 OF EXAMPLE (1a) OF CAST PRODUCT

100μm

INTERMEDIATE PORTION B2 OF EXAMPLE (1a) OF CAST PRODUCT

100μm

TIP END PORTION B1 OF EXAMPLE (1a) OF CAST PRODUCT

100μm

BASE END PORTION B3 OF EXAMPLE (1a) OF CAST PRODUCT

25μm

BASE END PORTION B3 OF EXAMPLE (1) OF CAST PRODUCT

25μm

BASE END PORTION B3
OF EXAMPLE (1a) OF
CAST PRODUCT

25μm

BASE END PORTION B3
OF EXAMPLE (1) OF
CAST PRODUCT

25μm

BASE END PORTION B3
OF EXAMPLE (1a) OF
CAST PRODUCT

25μm

BASE END PORTION B3
OF EXAMPLE (1) OF
CAST PRODUCT

25μm

100μm

FE ALLOY MATERIAL FOR THIXOCASTING AND METHOD FOR HEATING THE SAME

FIELD OF THE INVENTION

The present invention relates to a thixocast Fe-based alloy material, and a process for heating the same.

BACKGROUND ART

In carrying out a thixocasting process, a procedure is employed which comprises heating an Fe-based alloy material into a semi-molten state in which a solid phase (a substantially solid phase and this term will also be applied hereinafter) and a liquid phase coexist, pouring the semi-molten Fe-based alloy material under a pressure into a cavity in a casting mold, and solidifying the semi-molten Fe-based alloy material under a pressure.

There is such a known Fe-based alloy material having a eutectic crystal amount Ec set in a range of 50% by weight≦Ec≦70% by weight (see Japanese Patent Application Laid-open No.5-43978).

However, if the eutectic crystal amount Ec is set to be equal to or larger than 50% by weight, the amount of graphite precipitated is increased in such an Fe-based alloy material, and hence, the mechanical properties of a cast product are substantially equivalent to those of a cast product made by casting. Therefore, with the conventional material, it is impossible to achieve an intrinsic purpose of enhancing the mechanical properties of the cast product made by the thixocasting process.

In a quenched area such as a thinner portion in the cast structure of the cast product, a portion which has been a spherical solid phase is transformed into a mixed structure of austenite and martensite. On the other hand, in a slowly cooled area such as a thicker portion, a portion which has been a spherical solid phase is transformed into a pearlite structure. Portions which have been liquid phases in both the areas are transformed into a ledeburite structure (a chilled structure).

If such a cast product is subjected to a thermal treatment, the following problem also arises: Graphite is finely precipitated in the quenched area, while it is precipitated in a coalesced manner in the slowly cooled area. As a result, the mechanical properties of both the areas are different from each other. For this reason, it is impossible to produce a cast product having mechanical properties uniform over the whole thereof.

Further, in the thixocasting process, the temperature of the semi-molten Fe-based alloy material, namely, the casting temperature is low as compared with the temperature of a molten metal. Therefore, when a cast product having a smaller thickness or having a complicated shape is produced by casting, the semi-molten Fe-based alloy material is cooled rapidly by the casting mold, and as a result, a portion which has been a liquid phase has a chilled structure having a low toughness. The chilled structure is liable to become a starting point for cracking on the solidification and shrinkage of the material, which is undesirable. Therefore, a measure to form an inner wall of a casting mold from a carbon material such as graphite is employed to moderate the quenching of the material. However, the following problem is encountered by utilizing the thixocasting process: The carbon material is worn violently and for this reason, the replacement of the casting mold must be performed frequently, which is uneconomic, and moreover, which results in a reduced productivity.

On the other hand, if the stability and productivity of components and metallographic structure and the like of the Fe-based alloy material are taken into consideration, it is optimal to produce such material by a continuous casting process. In the continuous casting process, however, the cooling rate of the Fe-based alloy material is high, and for this reason, a chilled structure may be produced in the material in some cases. When such an Fe-based alloy material is heated, the following problem arises: The temperature gradient of the inside of the material is increased depending on heating conditions, whereby cracks are produced in the material, and the material cannot be heated to a target temperature during induction-heating.

DISCLOSURE OF THE INVENTION

Accordingly, it is an object of the present invention to provide a thixocast Fe-based alloy material of the above-described type, from which a cast product having mechanical properties which are more excellent than those of a cast product made by casting, and which are uniform over the whole of the cast product, can be produced.

To achieve the above object, according to the present invention, there is provided a thixocast Fe-based alloy material comprising 1.8% by weight≦C≦2.5% by weight, 1.0% by weight≦Si≦3.0% by weight, 0.1% by weight≦Mn≦1.5% by weight, 0.5% by weight>Ni≦3.0% by weight, and as the balance, iron (Fe) including inevitable impurities, and wherein a eutectic crystal amount Ec is in a range of 10% by weight<Ec<50% by weight.

A semi-molten Fe-based alloy material having liquid and solid phases coexisting therein is prepared by subjecting the Fe-based alloy material having the above composition to a heating treatment. In this semi-molten Fe-based alloy material, the liquid phase produced by a eutectic melting has a large latent heat. As a result, in the course of solidification of the semi-molten Fe-based alloy material, the liquid phase is supplied in a sufficient amount around the solid phase in response to the solidification and shrinkage of the solid phase, and is then solidified. Therefore, the generation of voids of a micron order in the cast product is prevented. In addition, the amount of graphite precipitated can be reduced by setting the eutectic crystal amount Ec in the above-described range. Thus, it is possible to enhance the mechanical properties, i.e., the tensile strength, the Young's modulus, the fatigue strength and the like of the cast product. In the Fe-based alloy material with the eutectic crystal amount Ec in the above-described range, it is possible to lower the casting temperature of the Fe-based alloy material, thereby providing the prolongation of the life of a casting mold.

However, if the eutectic crystal amount Ec is equal to or smaller than 10% by weight, the casting temperature of the Fe-based alloy material approximates to a liquidus temperature due to the small eutectic crystal amount Ec. Therefore, a heat load of a material transporting equipment to a pressure casting apparatus is high, thereby making it impossible to carry out the thixocasting. On the other hand, a disadvantage raised when Ec≧50% by weight is as described above.

In the above-described composition, manganese (Mn) is a cementite and austenite producing element, and nickel (Ni) is an austenite producing element. Therefore, Mn and Ni inhibit the slowly cooled area from being transformed into a pearlite structure. Thus, the cast structure of the entire cast product is such that a portion which has been a solid phase is transformed into a mixed structure of austenite and martensite, and a portion which has been a liquid phase is transformed into a ledeburite structure.

By subjecting such a cast product into a predetermined thermal treatment, a cast product having a uniformly thermally treated structure with fine graphite dispersed in a mixed structure of ferrite and pearlite is produced. This cast product has mechanical properties uniform over the whole thereof.

In the above-described composition, carbon (C) and silicon (Si) participate in the eutectic crystal amount, and the C content and the Si content are set in the above-described ranges to control the eutectic crystal amount in the above-described range. However, if the C content is smaller than 1.8% by weight, the casting temperature must be high, even if the Si content is increased to increase the eutectic crystal amount. Therefore, the advantage of the thixocasting is degraded. On the other hand, if C>2.5% by weight, the amount of graphite is increased. For this reason, the mechanical properties of the cast product is degraded, and the eutectic crystal amount is increased and hence, the handlability of the semi-molten Fe-based alloy material is deteriorated. If the Si content is smaller than 1.0% by weight, the casting temperature is raised as the case where the C content is smaller than 1.8% by weight. On the other hand, if Si>3.0% by weight, silico-ferrite is produced and for this reason, the mechanical properties of the cast product cannot be enhanced.

Manganese (Mn) functions as a deoxidizing agent and is required for producing cementite. However, if the Mn content is smaller than 0.1% by weight, the deoxidizing effect is smaller and for this reason, defects due to inclusion of an oxide caused by the oxidation of the molten metal and due to bubbles are liable to be produced. On the other hand, if Mn>1.5% by weight, the amount of cementite $[(FeMn)_3C]$ crystallized is increased. For this reason, it is difficult to finely divide the large amount of cementite by a thermal treatment, resulting in a reduced toughness and a reduced cutting property of a cast product.

Nickel (Ni) is an austenite producing element, as described above, and has an effect which allows austenite to exist in a very small amount at normal temperature to enclose impurities in the austenite, thereby enhancing the toughness. To provide such effect, it is necessary to set the Ni content at about 1% by weight. However, if the Ni content is smaller than 0.5% by weight, the addition of nickel is meaningless. On the other hand, if Ni>3.0% by weight, amatrix is transformed into a martensite structure with an increased hardness in the course of cooling following a cementite-eliminating thermal treatment.

It is another object of the present invention to provide a thixocast Fe-based alloy material of the above-described type, wherein the generation of cracks in a thin cast product and the like can be avoided.

To achieve the above object, according to the present invention, there is provided a thixocast Fe-based alloy material comprising 1.8% by weight≦C≦2.5% by weight 1.0% by weight≦Si≦3.0% by weight 0.8% by weight≦Mn≦1.5% by weight, and as the balance, iron (Fe) including inevitable impurities, and wherein a eutectic crystal amount Ec being in a range of 10% by weight<Ec<50% by weight.

When a thixocasting is carried out using the Fe-based alloy material having the above composition and using a conventional casting mold, a portion which has been a solid phase is transformed into a mixed structure of austenite and martensite in the entire thin cast product due to the presence of Mn which is an austenite producing element, and a portion which has been a liquid phase is transformed into a ledeburite structure. In this way, the toughness of the entire structure is enhanced by the austenite remaining in the portion which has been the solid phase. Therefore, in the thin cast product and the like, the generation of cracks due to the solidification and shrinkage is avoided. In addition, it has been made clear that if the above Fe-based alloy material is used, the pearlite transformation of a thick portion cooled at a low speed in the cast product can be inhibited to ensure that austenite remains in the portion which has been the solid phase.

In the alloy composition of this material, manganese (Mn) is an austenite producing element and has an effect of permitting austenite to remain in the portion which has been the solid phase, as described above. If the Mn content is smaller than 0.8% by weight, the amount of austenite remaining in the portion which has been the solid phase is insufficient, and the amount of austenite crystallized in ledeburite presenting a chilled structure is also insufficient. On the other hand, if Mn >1.5% by weight, the amount of cementite $[(FeMn)_3C]$ precipitated in ledeburite is increased, resulting in reduced toughness and cutting property of a product. Mn also has a function as a deoxidizing agent.

The reason why the eutectic crystal amount Ec, the C content and the Si content are limited in the Fe-based alloy material is the same as described above.

In addition, according to the present invention, there is provided a thixocast Fe-based alloy material, comprising carbon (C) of a content in a range of 1.8% by weight≦C≦2.5% by weight, silicon (Si) of a content in a range of 1.0% by weight≦Si≦3.0% by weight, manganese (Mn) of a content in a range of 0.6% by weight≦Mn≦1.5% by weight, at least one of nickel (Ni) of a content in a range of 0.2% by weight≦Ni≦3.0% by weight and titanium (Ti) of a content in a range of 0.05% by weight≦Ti≦0.6% by weight, the total sum of the Mn content, the Ni content and the Ti content being equal to or larger than 0.8% by weight (Mn+Ni+Ti≧0.8% by weight), and the balance of iron (Fe) including inevitable impurities, a eutectic crystal amount Ec being in a range of 10% by weight<Ec<50% by weight.

If the Fe-based alloy material having the above composition is used, the generation of cracks due to the solidification and shrinkage can be further reliably avoided in a thin cast product.

The reason why the eutectic crystal amount, the C content and the Si content are limited in the Fe-based alloy material is the same as described above.

Nickel (Ni), which is an austenite producing element, acts to further promote the remaining of austenite and to enclose impurities in the remaining austenite for harmlessness. Namely, nickel (Ni) has an effect of dispersing the impurities reducing the toughness into the austenite rich in toughness, thereby preventing the impurities from influencing the mechanical properties. In addition, nickel (Ni) also has an effect of preventing the pearlite transformation of a portion cooled slowly such as a thick portion. However, If the Ni content is smaller than 0.2% by weight, the addition of nickel is meaningless. On the other hand, if the Ni content is larger than 3.0% by weight, when the cast product is subjected to a thermal treatment in order to ensure that cementite disappears, thereby forming spherical fine graphite grains, the precipitated graphite grains are agglomerated at points at points to bring about a reduction in toughness. In addition, the matrix is transformed into martensite by the cooling carried out after the thermal treatment, resulting in an increased hardness. Further, the addition of an excessive amount of nickel brings about an increase in material cost.

Titanium (Ti) has an effect.of finely dividing the crystal grains in the solid phase to further enhance the toughness of the cast product. However, if the Ti content is smaller than 0.05% by weight, the addition of titanium is meaningless. On the other hand, if Ti>0.6% by weight, TiC is precipitated and for this reason, the cutting property is reduced and the flowability of the molten metal is reduced, resulting in the generation of casting defects.

The lower limit value of the Mn content may be decreased down to 0.6% by weight, lower than that of the Fe-based alloy material, because of the containment of titanium (Ti) and/or nickel (Ni). The reason why the upper limit value of the Mn content is limited is the same as described above.

Even in a casting process by casting, it is possible to allow austenite to remain, but for this purpose, the cooling rate must be managed extremely severely. According to the present invention, the remaining of austenite in a portion which has been a solid phase has been realized in the thixocasting process by specifying the total amount of the Mn content and the Ni and Ti contents (or the Ni or Ti content). A lower limit value of the total amount of the Mn content and the Ni and Ti contents (or the Ni or Ti content), 0.8% by weight, is a condition for providing the above-described effect without being influenced by the cooling rate.

It is desirable that the solid phase rate R in the semi-molten Fe-based alloy material in the thixocasting process is larger than 50%. This makes it possible to shift the casting temperature to a lower level to prolong the life of a pressure casting apparatus. If the solid phase rate R is equal to or smaller than 50%, the amount of the liquid phase is increased. For this reason, when a short columnar semi-molten Fe-based alloy material is transported in a standing state, the self-standing property thereof is degraded, and the handlability thereof is also degraded.

Further, it is an object of the present invention to provide a heating process, by which a thixocast Fe-based alloy material having a chilled structure can be heated into a semi-molten state without generation of cracks in the material.

To achieve the above object, according to the present invention, there is provided a process for heating a thixocast Fe-based alloy material having a chilled structure into a semi-molten state in which solid and liquid phases coexist, wherein the average rate HR of heating to a point Al in an Fe—C based equilibrium diagram is set in a range of 0.5° C./sec$\leqq H_R \leqq$6.0° C./sec, and the maximum temperature gradient $T_G$ of the inside of the Fe-based alloy material per unit distance is set at $T_G \leqq 7°$ C./mm.

The average rate $H_R$ of heating to a point $A_1$ and the maximum temperature gradient $T_G$ are specified as described above, the cracking due to the heating of the Fe-based alloy material having the chilled structure can be prevented, and the oxidation of the material and the coalescence of crystal grains cannot occur. After the temperature exceeds the point $A_1$, the heating rate is increased to effect the decomposition of dendrite and the spheroidization of the solid phase. At this time, a γ-phase appears in the Fe-based alloy material, resulting in an enhanced toughness of the material. Therefore, even if the heating rate is increased, cracks cannot be produced in the Fe-based alloy material.

Both of 6.0° C./sec which is an upper limit value for the average heating rate $H_R$ and 7° C./mm which is an upper limit value for the maximum temperature gradient $T_G$ are limit values for preventing the generation of cracks due to the heating. If the average heating temperature $H_R$ is lower than 0.5° C./sec, problems of a reduction in producibility of a cast product, the coalescence of the solid phases and the oxidation of the material surface arise.

The Fe-based alloy material which is the subject of the present invention is not limited to a material produced by a continuous casting process, and may be a material produced by casting and having a chilled structure.

To determine whether the Fe-based alloy material has a chilled structure, it is a common practice to observe the material by a metal microscope, but it is convenient to use an ultrasonic velocity measuring process which is one of non-destructive inspecting processes for a metal. The sonic velocity Sv measured by the ultrasonic velocity measuring process is in a range of 5,800 m/sec$\leqq$Sv$\leqq$6,000 m/sec in a case of a steel. On the other hand, the reviews by the present inventors have made it clear that in a thixocast graphite-crystallized Fe-based alloy material, a flake-formed graphite phase is reflected as a defect to a measured value of sonic velocity and hence, the sonic velocity Sv assumes a low value in a range of 5,100 m/sec$\leqq$Sv$\leqq$5,450 m/sec, but in an Fe-based alloy material having a chilled structure, the sonic velocity assumes a value near that of a steel due to non-precipitation of graphite. Therefore, it can be determined from such a difference between the sonic velocities that if the sonic velocity Sv measured for the Fe-based alloy material by the ultrasonic velocity measuring process is a value$\leqq$5,600 m/sec, this material is an Fe-based alloy material having a chilled structure.

BEST MODE FOR CARRYING OUT THE INVENTION

Embodiment I

Figure 1:
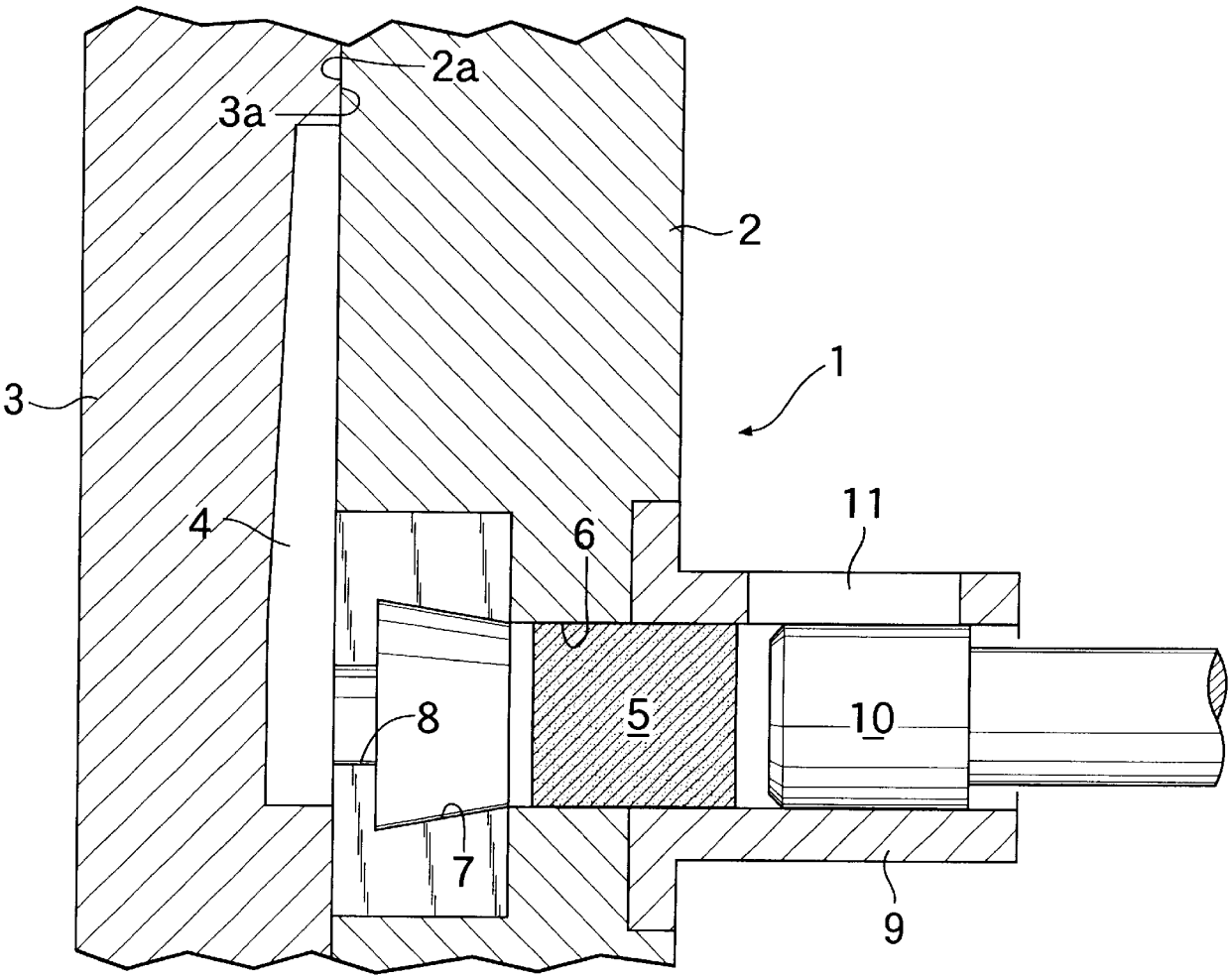
FIG. 1 is a sectional view of a pressure casting apparatus.

A pressure casting apparatus 1 shown in FIG. 1 is used to produce a cast product by casting by using an Fe-based alloy material and utilizing a thixocasting process. The pressure casting apparatus 1 includes a stationary die 2 and a movable die 3 which have vertical mating surfaces 2*a* and 3*a*, respectively, so that a cast product forming cavity 4 is defined between both the mating surfaces 2*a* and 3*a*. A chamber 6 is defined in the stationary die 2, so that a columnar semi-molten Fe-based alloy material 5 is placed horizontally in the chamber 6. The chamber 6 communicates with a base end of the cavity 4 through a truncated bore 7 and a gate 8. A sleeve 9 is horizontally mounted to the stationary die 2 to communicate with the chamber 6. A pressing plunger 10 is slidably received in the sleeve 9, so that it is inserted into and removed out of the chamber 6. The sleeve 9 has a material inlet 11 in an upper portion of a peripheral wall thereof. Each of the stationary and movable dies 2 and 3 is formed of a Cu—Be based alloy as a copper-based alloy. The copper-based alloy which may be used is a Cu—Cr based alloy, Cu—Ni based alloy and the like. Pure copper may be utilized as a die forming material.

Figure 2:
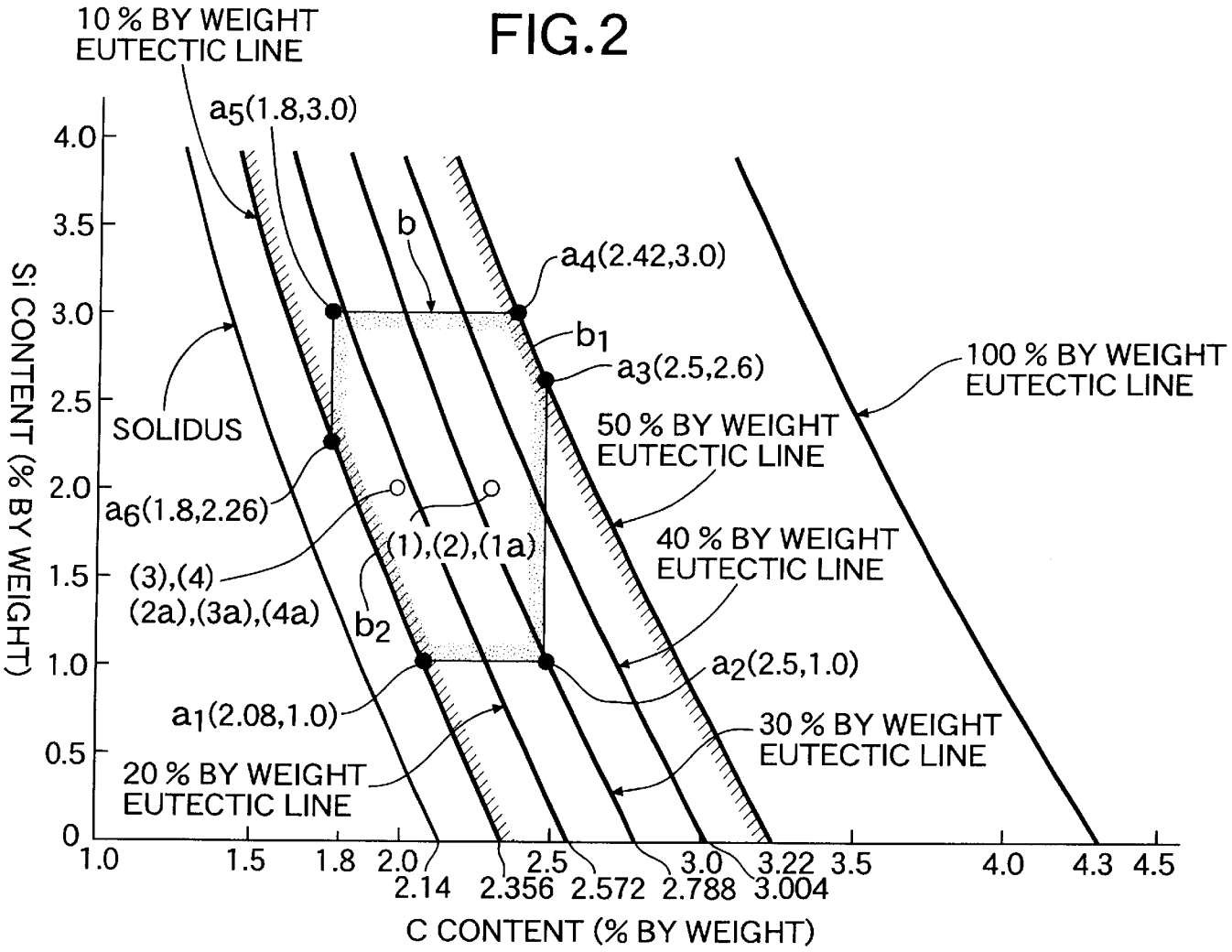
FIG. 2 is a graph showing the relationship between C and Si contents and a eutectic crystal amount Ec.

FIG. 2 shows the relationship between the C and Si contents and a eutectic crystal amount Ec in an Fe-based alloy material. In FIG. 2, a 10% by weight eutectic crystal line with a eutectic crystal amount Ec of 10% by weight exists adjacent a high C-concentration side of a solidus, and a 50% by weight eutectic crystal line with a eutectic crystal amount Ec of 50% by weight exists adjacent a low C-concentration side of a 100% by weight eutectic crystal line with a eutectic crystal amount Ec of 100% by weight. Three lines between the 10% by weight eutectic crystal line and the 50% by weight eutectic crystal line are 20, 30 and 40% by weight eutectic crystal lines in order from the 10% by weight eutectic crystal line, respectively.

For the composition range of the Fe-based alloy material, the eutectic crystal amount Ec is in a range of 10% by weight<Ec<50% by weight and therefore, in a range between the 10% by weight eutectic crystal line and the 50% by weight eutectic crystal line. However, compositions on the 10% by weight eutectic crystal line and the 50% by weight eutectic crystal line are excluded. In addition, the C content is in a range of 1.8% by weight≦C≦2.5% by weight and the Si content is in a range of 1.0% by weight≦Si≦3.0% by weight. Hence, when the C content is taken on an X axis, and the Si content is taken on a Y axis in FIG. 2, the composition range of the Fe-based alloy material is in a range represented by a substantially hexagonal figure formed by connecting a coordinate (2.08, 1.0) point $a_1$, a coordinate (2.5, 1.0) point $a_2$, a coordinate (2.5, 2.6) point $a_3$, a coordinate (2.42, 3.0) point $a_4$, a coordinate (1.8, 3.0) point $a_5$ and a coordinate (1.8, 2.26) point $a_6$ to one another. However, compositions at the points $a_3$ and $a_4$ lying on the 50% by weight eutectic crystal line and on a line segment $b_1$ connecting the points $a_3$ and $a_4$, and compositions at the points $a_1$ and $a_6$ lying on the 10% by weight eutectic crystal line and on a line segment $b_2$ connecting the points $a_1$ and $a_6$ are excluded from the compositions on a profile b of the figure indicating the limit of the composition range.

Figure 3:
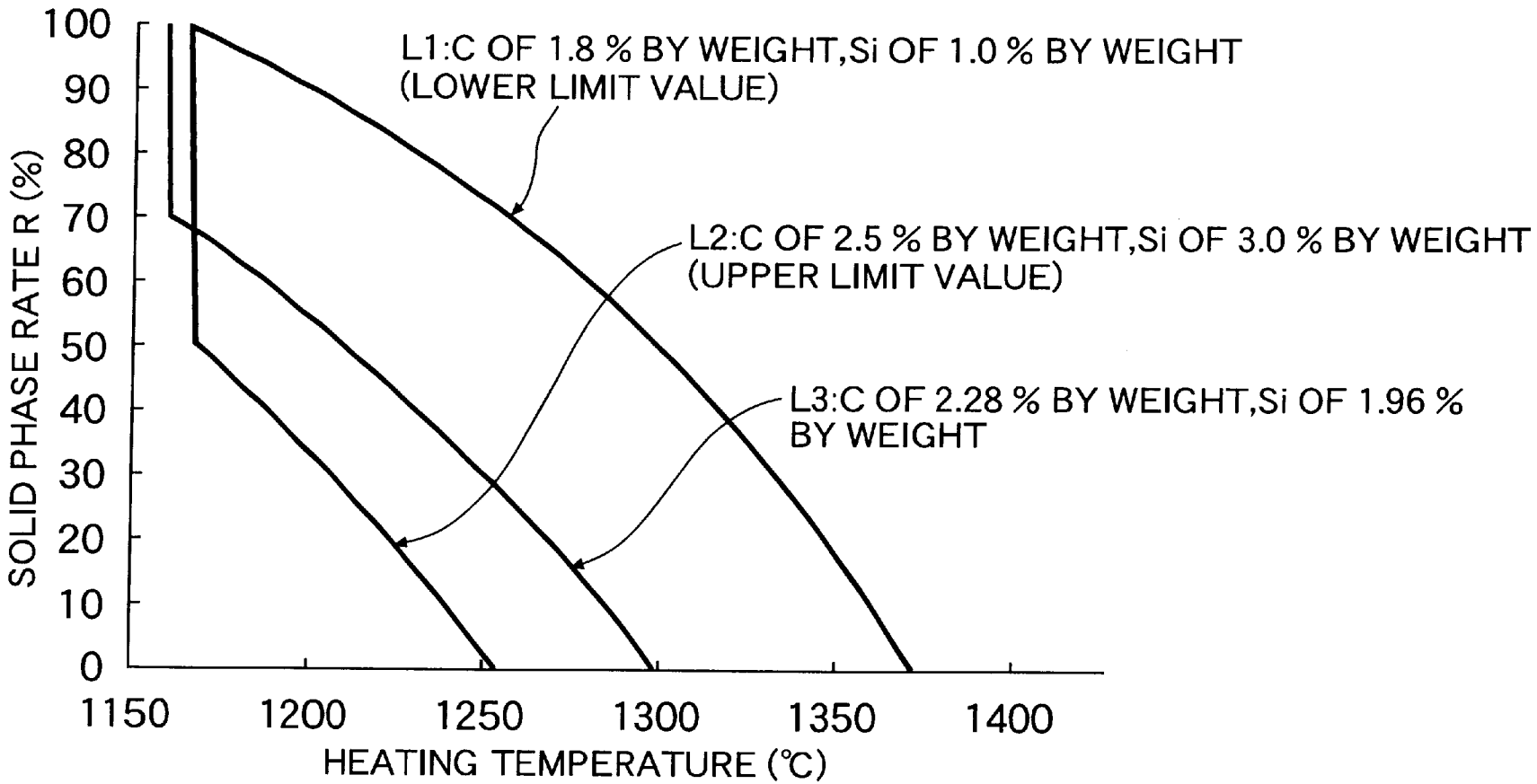
FIG. 3 is a graph showing the relationship between a heating temperature and a solid phase rate in correspondence to the C and Si contents.

It is desirable that the solid phase rate R of the semi-molten Fe-based alloy material is larger than 50%. FIG. 3 is a graph showing the relationship between a heating temperature and a solid phase rate R for an Fe—C—Si based alloy. A line L1 corresponds to the case where the C and Si contents are 1.8% by weight and 1.0% by weight which are lower limit values, respectively, and a line L2 corresponds to the case where the C and Si contents are 2.5% by weight and 3.0% by weight which are upper limit values, respectively. It can be seen that if the C and Si contents are smaller than the lower limit values, the casting temperature must be considerably high in order to provide a solid phase rate R higher than 50% by weight. Namely, at a casting temperature set from the viewpoint of the durability of the pressure casting apparatus and the like, the solid rate R of the material is high and for this reason, casting defects due to a filling failure or a cold shut are produced. On the other hand, if the C and Si contents are higher than the upper limit values, the solid phase rate R of the material is lower and for this reason, the chilled structure is increased and cracks are liable to be produced.

Table 1 shows the composition and the eutectic crystal amount Ec for example (1) and comparative example (1a) of Fe-based alloy material.

TABLE 1

| Fe-based alloy material | Chemical constituent (% by weight) C | Si | Mn | Ni | P | S | Fe | Eutectic crystal amount Ec (% by weight) |
|---|---|---|---|---|---|---|---|---|
| Example (1) | 2.3 | 2.0 | 1.2 | 1.1 | <0.04 | <0.04 | Balance | 33 |
| Comparative Example (1a) | 2.3 | 2.0 | 0.2 | — | <0.04 | <0.04 | Balance | 33 |

Example (1) and comparative example (1a) are also shown as points (1) and (1a) in FIG. 2.

To produce a cast product by casting, example (1) was subjected to an induction heating up to 1180° C. which is a casting temperature, thereby preparing a semi-molten Fe-based alloy material having solid and liquid phases coexisting therein. The solid phase rate R of this material was equal to 58%.

Figure 4:
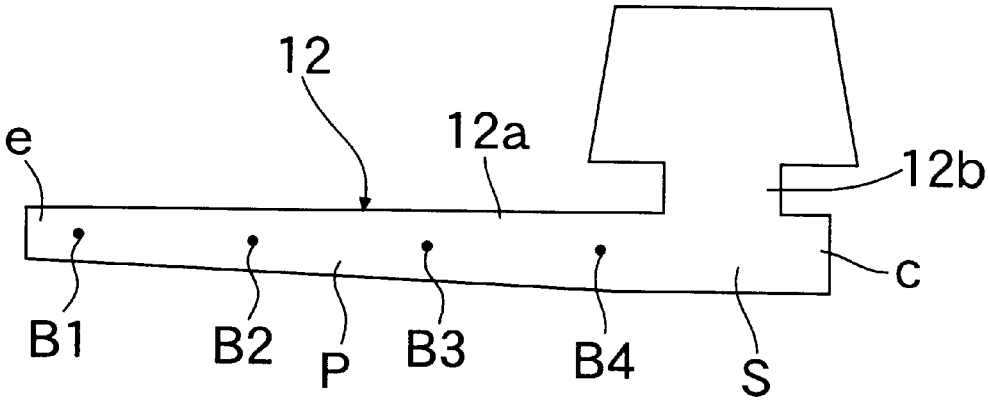
FIG. 4 is a diagram for explaining a cast product.

Then, the temperature of the stationary and movable dies 2 and 3 in the pressure casting apparatus 1 shown in FIG. 1 was controlled, and the semi-molten Fe-based alloy material 5 was placed into the chamber 6. Thereafter, the pressing plunger 10 was operated to pour the Fe-based alloy material 5 into the cavity 4. In this case, the pouring pressure for the semi-molten Fe-based alloy material 5 was 36 MPa. Then, a pressing force was applied to the semi-molten Fe-based alloy material 5 filled in the cavity 4 by retaining the pressing plunger 10 at a terminal end of its stroke, thereby solidifying the semi-molten Fe-based alloy material 5 under such pressure to produce example (1) of a cast product 12 shown in FIG. 4. Using comparative example (1a), example (1a) of the cast product 12 was produced in a similar manner. However, the casting temperature was set at 1180° C.

In a cavity-correspondence portion 12*a* of t e cast product 12, an area from a site B4 in the vicinity of a gate-correspondence portion 12*b* and nearer to a tip end of the cavity than the gate-correspondence portion 12*b* to a base end c of the cavity-correspondence portion 12*a* is a scrap S and hence, an area from the site B4 to a tip end e of the cavity-correspondence 12*a* is a product P.

Figure 5C:
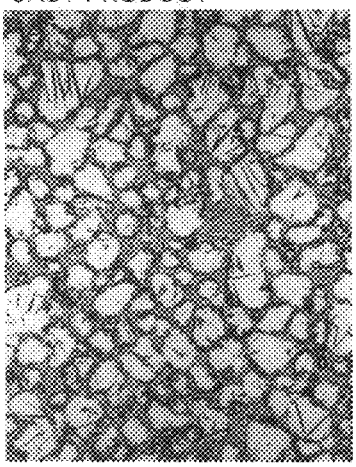
FIG. 5C is a photomicrograph of the texture showing a cast structure of a base end portion B3 of example (1) of the cast product.
Figure 5B:
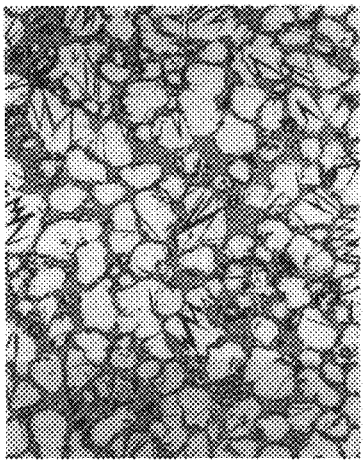
FIG. 5B is a photomicrograph of the texture showing a cast structure of an intermediate portion B2 of example (1) of the cast product.
Figure 5A:
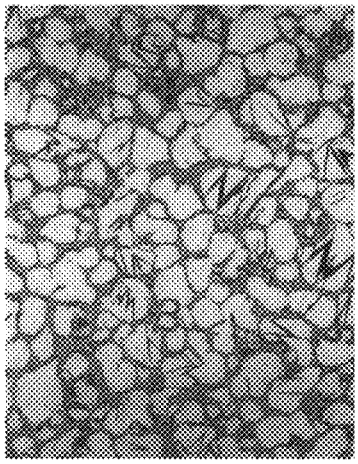
FIG. 5A is a photomicrograph of the texture showing a cast structure of a tip end portion B1 of example (1) of a cast product.
Figure 6C:
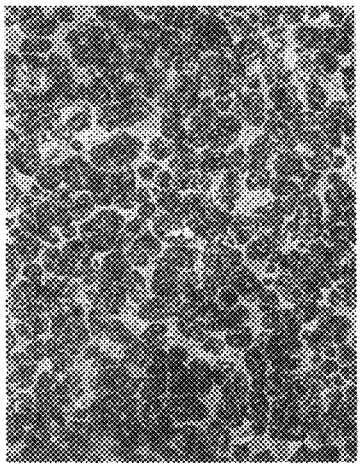
FIG. 6C is a photomicrograph of the texture showing a cast structure of a base end portion B3 of example (1a) of the cast product.
Figure 6B:
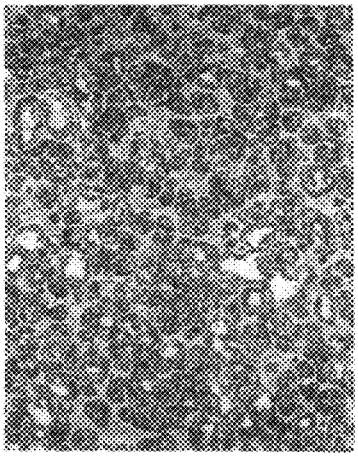
FIG. 6B is a photomicrograph of the texture showing a cast structure of an intermediate portion B2 of example (1a) of the cast product.
Figure 6A:
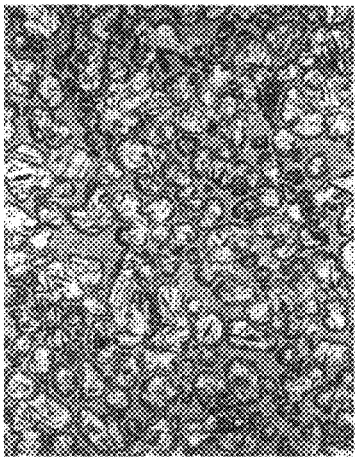
FIG. 6A is a photomicrograph of the texture showing a cast structure of a tip end portion B1 of example (1a) of cast product.

Central portions of a tip end portion B1, an intermediate portion B2 and a base end portion B3 in each of the products P of both the cast products 12 were microscopically examined, whereby their cast structures were examined to provide results in FIGS. 5A to 5C for example (1) of the cast product 12 and in FIGS. 6A to 6C for example (1a) of the cast product 12.

In example (1) of the cast product 12 shown in FIGS. 5A to 5C, those areas of the tip end portion B1, the intermediate portion B2 and the base end portion B3, which had been asperical solid phase, were of a mixed structure of austenite and martensite, and the areas which had been a liquid phase were of a ledeburite structure.

In example (1a) of the cast product 12 shown in FIGS. 6A to 6C, those areas of the tip end portion B1 and the intermediate portion B2 which had been a spherical solid phase were of a mixed structure of austenite and martensite; those areas of the base end portion B3 which had been spherical solid phase were of a pearlite structure; and the areas which had been a liquid phase were of a ledeburite structure.

In example (1) of the cast product 12 made using example (1), the cast structure of the base end portion B3 was the same as those of the tip end portion B1 and the intermediate portion B2, notwithstanding that the base end portion B3 was slowly cooled by the heat insulating effect of the scrap S. On the contrary, in example (1a) of the cast product 12 made using comparative example (1a), the base end portion B3 had a cast structure different from those of the tip end portion B1 and the intermediate portion B2, because the base end portion B3 was slowly cooled by the heat insulating effect of the scrap S and no means for avoiding the slow cooling effect was taken.

A plurality of test pieces including the base end portions B3 were made from examples (1) and (1a) of the cast product 12. Then, the test pieces were subjected to a thermal treatment. Thereafter, the test pieces were microscopically examined for examination of their thermally-treated structures to provide results shown in FIGS. 7A, 7B to 9A and 9B.

Figure 7B:
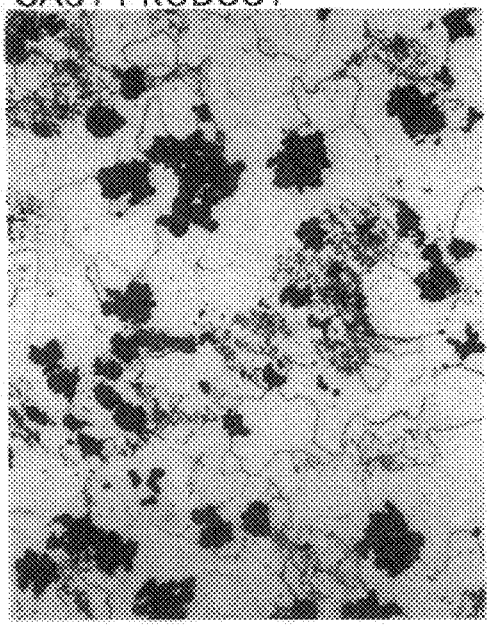
FIG. 7B is a photomicrograph of the texture showing a first example of a thermally treated structure in the base end portion B3 of example (1a) of the cast product.
Figure 7A:
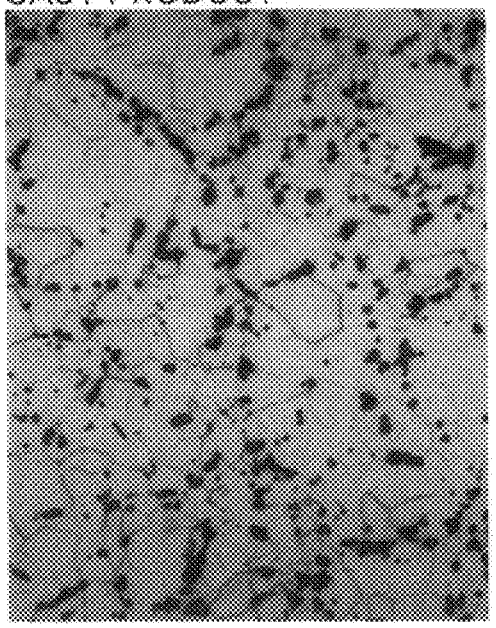
FIG. 7A is a photomicrograph of the texture showing a first example of a thermally treated structure in the base end portion B3 of example (1) of the cast product.

FIGS. 7A and 7B show thermally treated structures provided by subjecting the test pieces to a ledeburite eliminating thermal treatment for 30 minutes at 900° C. and for 60 minutes at 750° C. FIG. 7A corresponds to the base end portion B3 of example (1) of the cast product 12, and FIG. 7B corresponds to the base end portion B3 of example (1a) of the cast product 12.

Figure 8B:
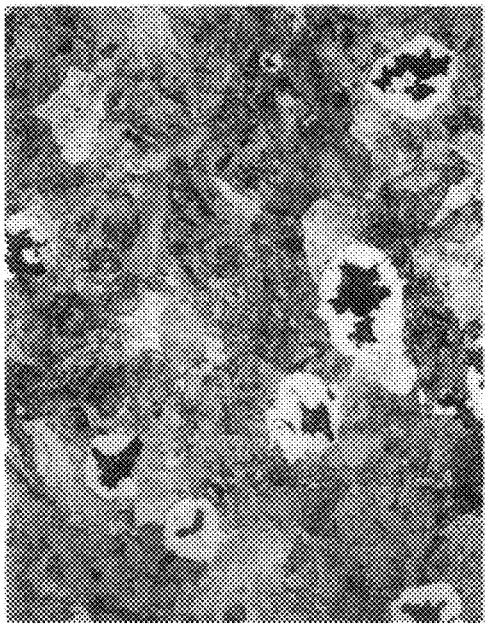
FIG. 8B is a photomicrograph of the texture showing a second example of a thermally treated structure in the base end portion B3 of example (1a) of the cast product.
Figure 8A:
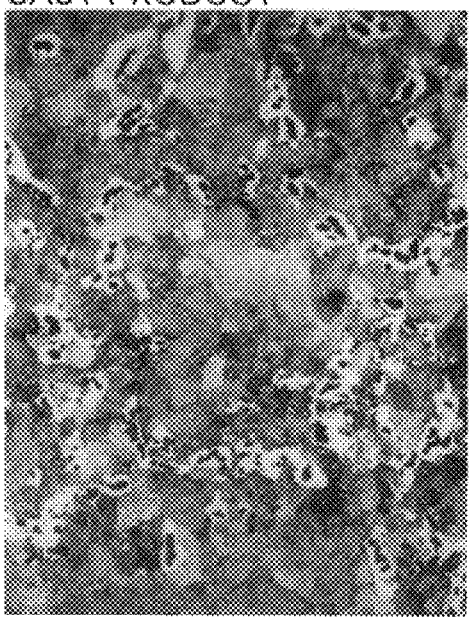
FIG. 8A is a photomicrograph of the texture showing a second example of a thermally treated structure in the base end portion B3 of example (1) of the cast product.

FIGS. 8A and 8B show thermally treated structures provided by subjecting the test pieces to a ledeburite eliminating thermal treatment for 30 minutes at 900° C. FIG. 8A corresponds to the base end portion B3 of example (1) of the cast product 12, and FIG. 8B corresponds to the base end portion B3 of example (1a) of the cast product 12.

Figure 9B:
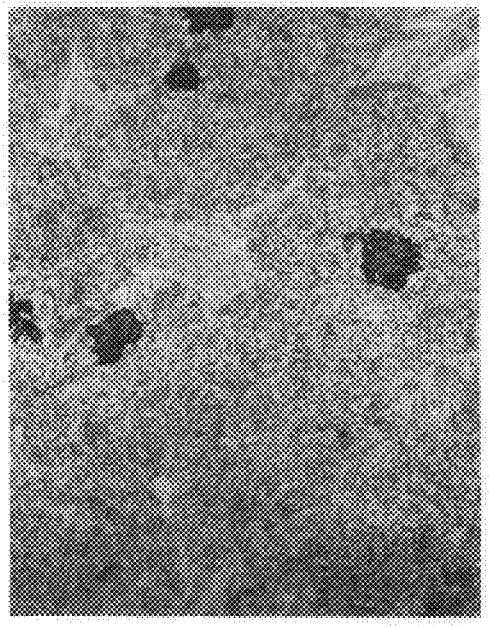
FIG. 9B is a photomicrograph of the texture showing a third example of a thermally treated structure in the base end portion B3 of example (1a) of the cast product.
Figure 9A:
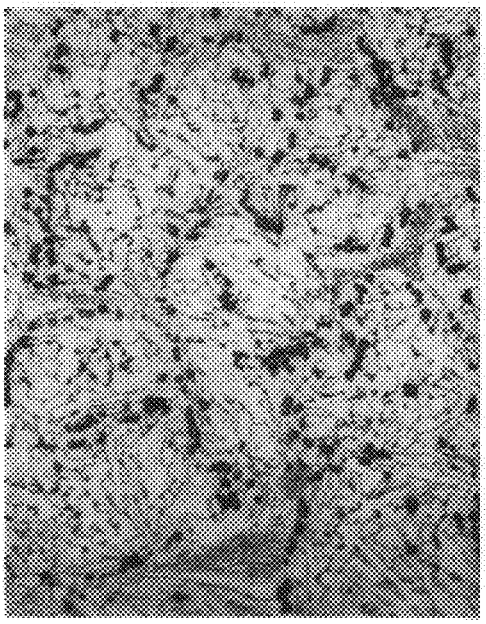
FIG. 9A is a photomicrograph of the texture showing a third example of a thermally treated structure in the base end portion B3 of example (1) of the cast product.

FIG. 9A and 9B show thermally treated structures provided by subjecting the test pieces to a cementite spheroidizing thermal treatment for 60 minutes at 800° C. FIG. 9A corresponds to the base end portion B3 of example (1) of the cast product 12, and FIG. 9B corresponds to the base end portion B3 of example (1a) of the cast product 12.

As is apparent from FIGS. 7A, 7B to 9A and 9B, fine graphite grains having a grain size d equal to or smaller than 10 $\mu$m were precipitated in the base end portion B3 of example (1) of the cast product 12. This applies to the tip end portion B1 and the intermediate portion B2. As a result, example (1) of the cast product 12 has mechanical properties uniform over the whole thereof. On the other hand, coalesced graphite grains having a grain size d larger than 10 $\mu$m were precipitated in the base end portion B3 of example (1a) of the cast product 12, but each of the tip end portion B1 and the intermediate portion B2 was of a thermally treated structure having fine graphite grains, as was the base end portion B3 of example (1). As a result, the mechanical properties of the tip end portion B1 and the intermediate portion B2 in example (1a) of the cast product 12 are different from those of the base end portion B3.

The graphite area rate, the hardness, the Charpy impact value (toughness) and the Young's modulus in the base end portions B3 of examples (1) and (1a) of the cast product 12 are as given in Table 2. In this case, the graphite area rate was determined using an image analysis device (IP-1000 PC made by Asahi Kasei, Co.) by polishing the test pieces without etching thereof.

TABLE 2

| Base end portion of cast product | Graphite area rate (%) | Hardness HB | Charpy impact value (J/cm$^2$) | Young's modulus (GPa) |
|---|---|---|---|---|
| FIG. 7A | 4.3 | 153 | 12.3 | 180 |
| FIG. 7B | 4.3 | 162 | 10.0 | 180 |
| FIG. 8A | 4.1 | 260 | 7.8 | 183 |
| FIG. 8B | 4.1 | 285 | 5.5 | 183 |
| FIG. 9A | 3.0 | 192 | 8.0 | 188 |
| FIG. 9B | 2.5 | 298 | 2.1 | 193 |

As is apparent from Table 2, the base end portion B3 of example (1) of the cast product 12 shown in each of FIGS. 7A, 8A and 9A has excellent mechanical properties, as compared with the base end B3 of example (1a) of the cast product 12 shown in FIGS. 7B, 8B and 9B.

Table 3 shows the composition and the eutectic crystal amount Ec for examples (2) to (4) and comparative examples (2a) to (4a).

TABLE 3

| Fe-based alloy | Chemical constituent (% by weight) | | | | | | | Eutectic crystal amount Ec |
|---|---|---|---|---|---|---|---|---|
| material | C | Si | Mn | Ni | P | S | Fe | (% by weight) |
| Example (2) | 2.3 | 2.0 | 0.6 | 1.1 | <0.04 | <0.04 | Balance | 33 |
| Example (3) | 2.0 | 2.0 | 1.2 | 1.1 | <0.04 | <0.04 | Balance | 17 |
| Example (4) | 2.0 | 2.0 | 0.6 | 2.0 | <0.04 | <0.04 | Balance | 17 |
| Comparative Example (2a) | 2.0 | 2.0 | 0.6 | — | <0.04 | <0.04 | Balance | 17 |
| Comparative Example (3a) | 2.0 | 2.0 | 0.2 | — | <0.04 | <0.04 | Balance | 17 |
| Comparative Example (4a) | 2.0 | 2.0 | 0.6 | 3.1 | <0.04 | <0.04 | Balance | 17 |

Examples (2) to (4) and comparative examples (2a) to (4a) are given as points (2) to (4) and points (2a) to (4a) in FIG. 2, respectively.

Examples (1) to (4) and comparative examples (1a) to (4a) of the cast products 12 were produced using the above-described examples (1) to (4) and comparative examples (1a) to (4a) in a manner similar to the above-described manner. Each of example (1) and other examples of the cast product 12 was subjected to an annealing treatment for 30 minutes at 900° C. and then microscopically examined for examination of their thermally treated structures.

Table 4 shows results of the above-described experiment. In Table 4, "Cu" in the column of material of die means the above-described Cu—Be based alloy, and "Fe" means an alloy tool steel for a high-temperature die. Further, "O" in the column of thermally treated structure means that the grain size d of graphite grains is equal to or smaller than 10 $\mu$m, and "X" means that the grain size d of graphite grains is larger than 10 $\mu$m.

TABLE 4

| Example of cast product | Casting temperature (° C.) | Material of die | Thermally treated structure: Tip end portion | Intermediate portion | Base end portion | Scrap |
|---|---|---|---|---|---|---|
| (1) | 1180 | Cu | ○ | ○ | ○ | ○ |
| | | Fe | ○ | ○ | ○ | X |
| (2) | 1180 | Cu | ○ | ○ | ○ | ○ |
| | | Fe | ○ | ○ | ○ | X |
| (3) | 1200 | Cu | ○ | ○ | ○ | ○ |
| | | Fe | ○ | ○ | ○ | X |
| (4) | 1200 | Fe | ○ | ○ | ○ | X |
| (1a) | 1180 | Cu | ○ | ○ | X | X |
| (2a) | 1220 | Fe | ○ | X | X | X |
| (3a) | 1220 | Fe | X | X | X | X |
| (4a) | 1200 | Fe | graphite grains were agglomerated at points at crystal grain boundary | | | |

In Table 4, in examples (1) to (3) of the cast product 12 produced using the stationary and movable dies 2 and 3 made of the Cu—Be based alloy, the thermally treated structures of the products P thereof are uniform, and moreover, the thermally treated structures of the scraps S thereof are equivalent to those of the products P due to the cooling promoting effect of the stationary and movable dies 2 and 3. However, if the stationary and movable dies 2 and 3 made of the above-described steel, including example (4) of the cast product 12, are used, the cooling promoting effect thereof is inferior to that of the dies made of the Cu—Be based alloy and hence, graphite grains are precipitated in coalesced forms in the scrap S.

In examples (1a) to (3a) of the cast product 12, an effect of nickel (Ni) is not obtained, because the Fe-based alloy materials (1a) to (3a) do not contain nickel (Ni). As a result, in the cases of examples (1a) and (2a) of the cast product 12, the thermally treated structures of the products P are non-uniform over the whole thereof. In the case of the example (3a) of the cast product 12, coalesced graphite grains were dispersed over the whole thereof. In the case of example (4a) of the cast product 12, graphite grains were agglomerated at points at a crystal grain boundary due to the Ni content of the Fe-based alloy material (4a) larger than 3.0% by weight.

Embodiment II

Figure 10:
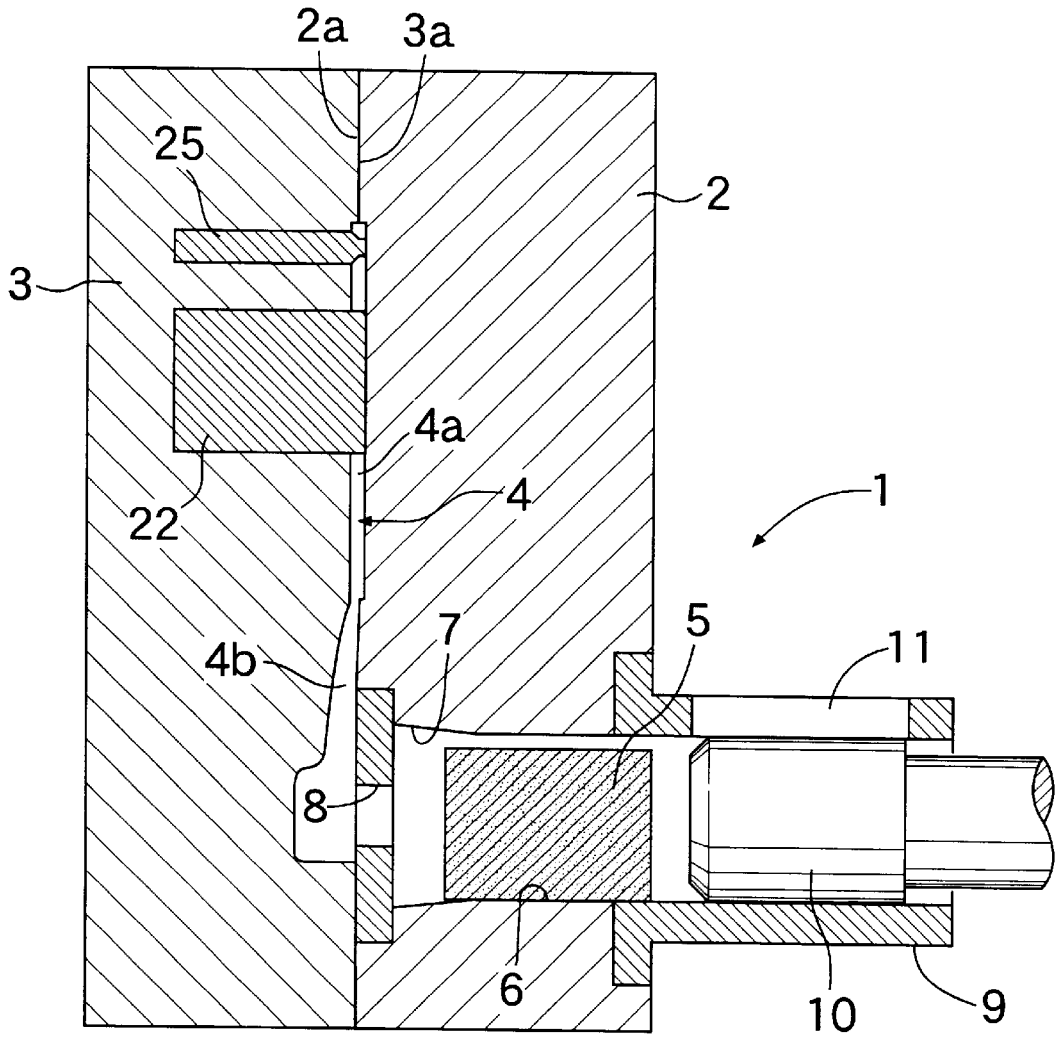
FIG. 10 is a sectional view of a pressure casting apparatus.
Figure 11:
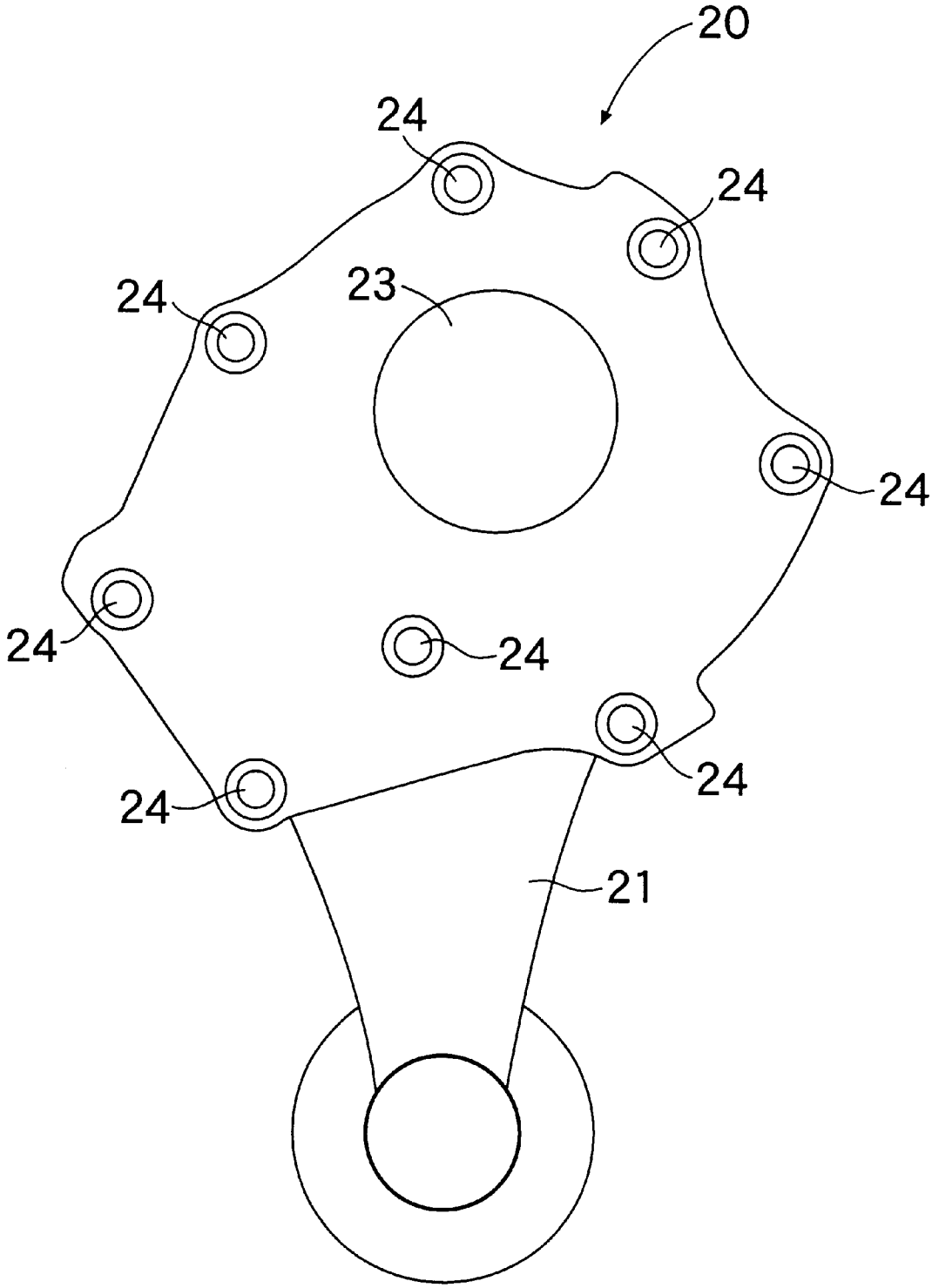
FIG. 11 is a plan view of an oil pump cover.

FIG. 10 shows a pressure casting apparatus 1 used to produce an oil pump cover by casting. In FIG. 10, the same components or portions as those in the apparatus 1 shown in FIG. 1 are designated by the same reference characters as in FIG. 1, and the detailed description of them is omitted. A scrap portion 21 is connected to an oil pump cover 20 shown in FIG. 11. In a cavity 4, a scrap portion forming area 4*b* exists between an oil pump cover forming area 4*a* and a gate 8. A movable die 3 is provided with a core 22 for forming a central bore 23 in the oil pump cover 20, and a plurality of cores 25 for forming a plurality of bolt bores 24 around the central bore 23. Each of the stationary and movable dies 2 and 3 is formed of a steel such as JIS SKD61 and the like, but may be formed of a copper-based alloy such as a Cu—Be based alloy, a Cu—Cr based alloy, a Cu—Ni based alloy and the like, when it is desired to enhance the cooling rate.

The relationship between the C and Si contents and the eutectic crystal amount Ec in the Fe-based alloy material is in accordance with FIG. 2.

Table 5 shows the composition and the eutectic crystal amount Ec for examples (5) to (13) and comparative examples (5a) to (10a).

TABLE 5

| Fe-based alloy material | Chemical constituent (% by weight) C | Si | Mn | Ti | Ni | P | S | Fe | Mn + Ni + Ti | Eutectic crystal amount Ec (% by weight) |
|---|---|---|---|---|---|---|---|---|---|---|
| Example (5) | 2.37 | 2.02 | 0.8 | — | — | 0.008 | 0.006 | Balance | 0.8 | 37 |
| Example (6) | 2.28 | 1.96 | 0.6 | — | 0.2 | 0.008 | 0.007 | Balance | 0.8 | 32 |
| Example (7) | 2.37 | 1.97 | 0.65 | 0.16 | — | 0.009 | 0.005 | Balance | 0.81 | 37 |
| Example (8) | 2.28 | 1.96 | 1.19 | — | — | 0.008 | 0.005 | Balance | 1.19 | 32 |
| Example (9) | 2.24 | 2.02 | 0.72 | — | 1.01 | 0.008 | 0.007 | Balance | 1.73 | 29 |
| Example (10) | 2.27 | 1.98 | 1.19 | — | 1.1 | 0.01 | 0.005 | Balance | 2.29 | 31 |
| Example (11) | 2.3 | 1.96 | 0.67 | 0.52 | 1.11 | 0.009 | 0.005 | Balance | 2.3 | 33 |
| Example (12) | 2.38 | 1.99 | 0.6 | — | 1.95 | 0.009 | 0.006 | Balance | 2.55 | 37 |
| Example (13) | 2.35 | 2.08 | 0.6 | — | 2.02 | 0.008 | 0.005 | Balance | 2.62 | 36 |
| Comparative Example (5a) | 2.36 | 2.02 | 0.21 | — | — | 0.01 | 0.005 | Balance | 0.21 | 36 |
| Comparative Example (6a) | 2.35 | 2.01 | 0.57 | — | — | 0.014 | 0.005 | Balance | 0.57 | 36 |
| Comparative Example (7a) | 2.4 | 1.9 | 0.5 | 0.05 | 0.21 | 0.011 | 0.005 | Balance | 0.76 | 39 |
| Comparative Example (8a) | 2.39 | 2.03 | 0.78 | — | — | 0.012 | 0.005 | Balance | 0.78 | 38 |
| Comparative Example (9a) | 2.3 | 2 | 0.1 | 0.51 | 0.2 | 0.008 | 0.007 | Balance | 0.81 | 33 |
| Comparative Example (10a) | 2.33 | 2.01 | 0.11 | 0.31 | 0.39 | 0.012 | 0.005 | Balance | 0.81 | 36 |

In FIG. 3, a line L3 indicates the relationship between the heating temperature and the solid phase rate R in example 2.

Each of example (5) of the columnar Fe-based alloy material having a diameter of 50 mm and a length of 65 mm and other examples was heated into a semi-molten state to produce the oil pump cover 20 having cored holes 23 and 24 at nine points and having the thinnest portion having a thickness of 2.5 mm using the pressure casting apparatus 1 shown in FIG. 10. In this case, the preheating temperature for the dies was set at 250° C., and the pressure maintaining time was set at 5 seconds.

Then, the presence or absence of cracks generated in each of the oil pump covers 20 was examined by a red mark check.

Table 6 shows the casting temperature, the solid phase rate R and the presence or absence of cracks for examples (5) to (13) and examples (5a) to (10a) of the oil pump covers 20. Examples (5) to (13) and examples (5a) to (10a) correspond to examples (5) to (13) and comparative examples (5a) to (10a) given in Table 5, respectively.

TABLE 6

| Oil pump cover | Casting temperature (° C.) | Solid phase rate R (%) | Presence or absence of cracks |
|---|---|---|---|
| (5) | 1180 | 59 | absence |
| (6) | 1190 | 60 | absence |
| (7) | 1190 | 55 | absence |
| (8) | 1190 | 60 | absence |
| (9) | 1190 | 60 | absence |
| (10) | 1200 | 53 | absence |
| (11) | 1190 | 66 | absence |
| (12) | 1190 | 60 | absence |
| (13) | 1180 | 59 | absence |
| (5a) | 1190 | 56 | presence |
| (6a) | 1190 | 56 | presence |
| (7a) | 1180 | 58 | presence |

TABLE 6-continued

| Oil pump cover | Casting temperature (° C.) | Solid phase rate R (%) | Presence or absence of cracks |
|---|---|---|---|
| (8a) | 1180 | 57 | presence |
| (9a) | 1200 | 55 | presence |
| (10a) | 1200 | 56 | presence |

Figure 12:
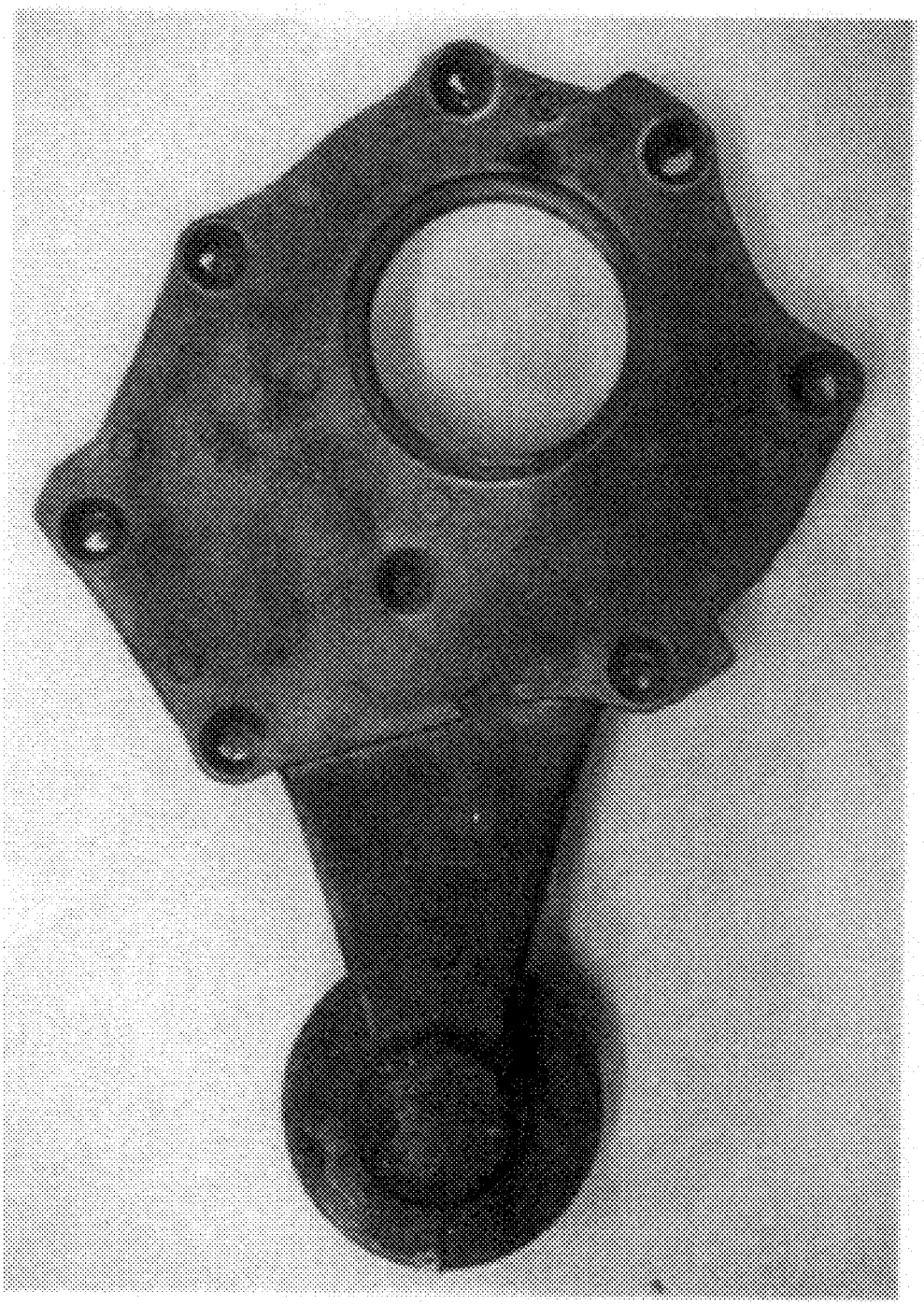
FIG. 12 is a view of a first example of the oil pump cover.
Figure 13:
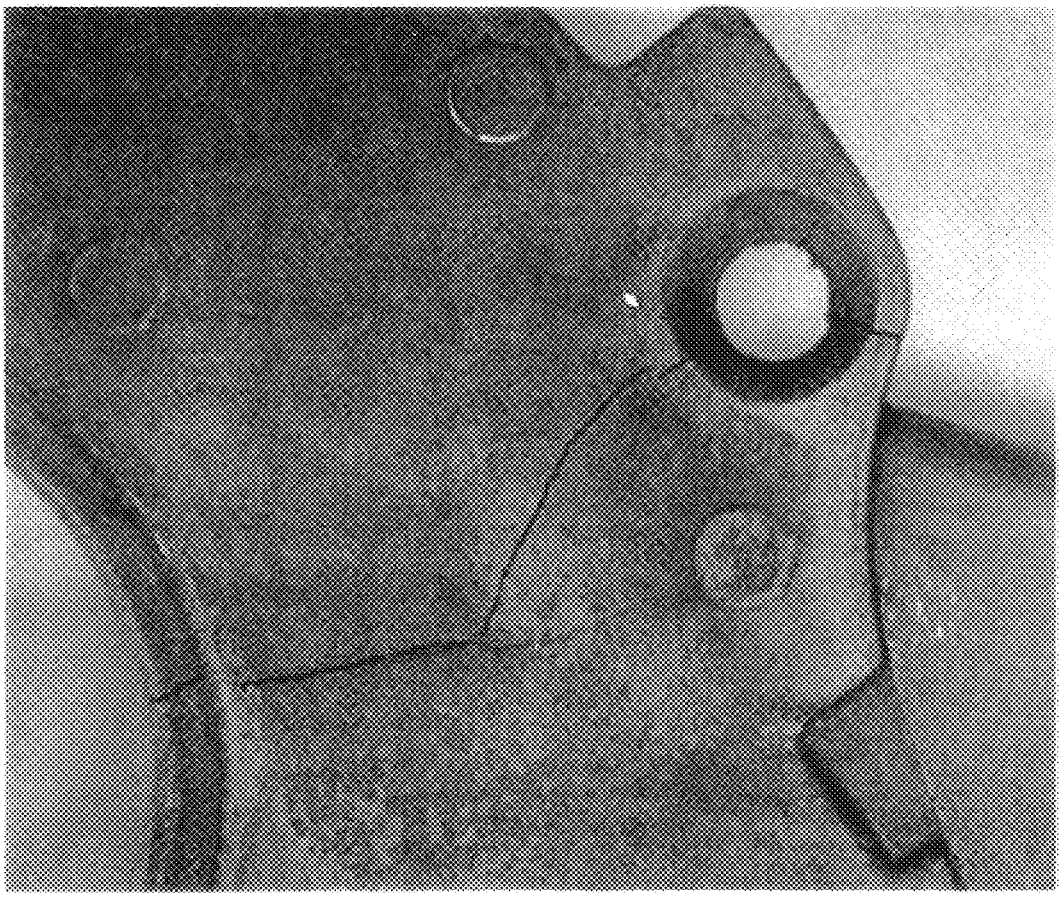
FIG. 13 is a view of a second example of the oil pump cover.
Figure 14:
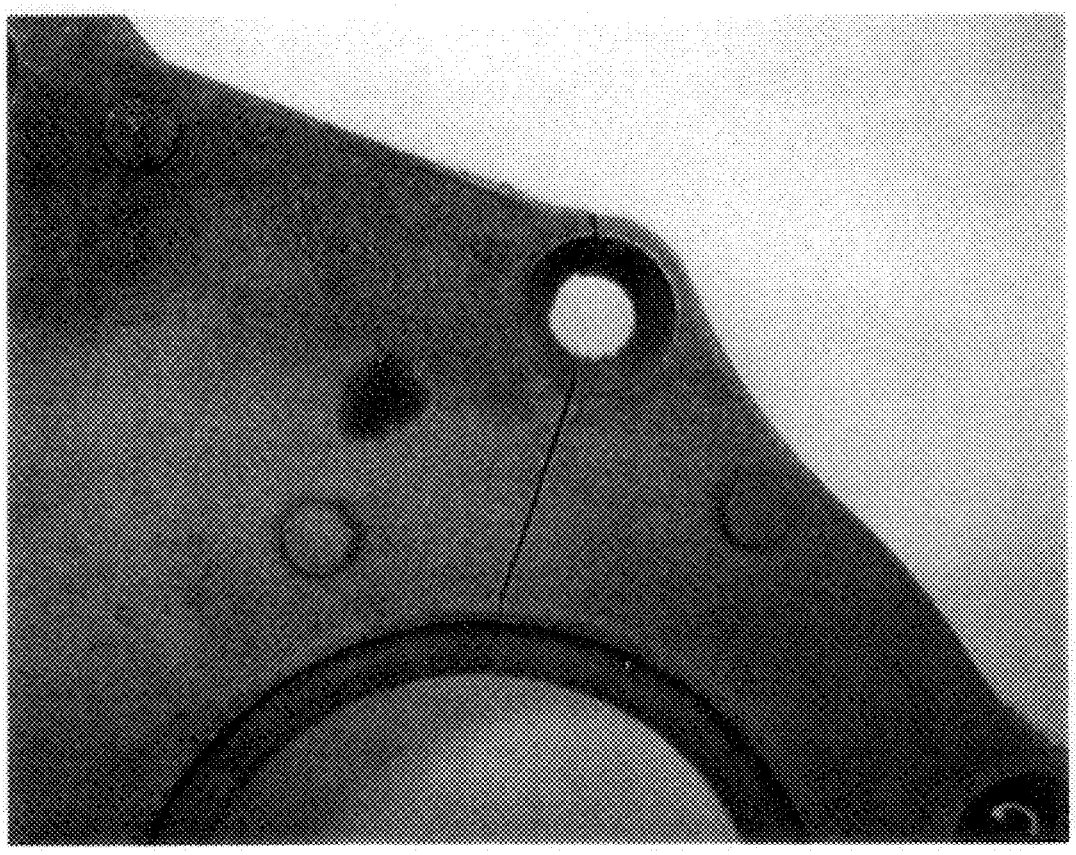
FIG. 14 is a view of a third example of the oil pump cover.

As is apparent from Table 6, no crack was generated in each of examples (5) to (13), whereas cracks were generated in all of examples (5a) to (10a). FIG. 12 is a view of the oil pump cover free of cracks, and FIG. 13 is a view of the oil pump cover having large fractures and hair cracks generated around the bolt bores. FIG. 14 is a view of the oil pump cover having cracks generated by being restrained by the two cores. As compared with the case where manganese (Mn) is contained alone, the cracks were generated in comparative examples (5a), (6a) and (8a), when the Mn content was equal to or smaller than 0.78% by weight, whereas no crack was generated in examples (5) and (8), because the Mn content was equal to or larger than 0.8% by weight. Therefore, it can be seen that when manganese (Mn) is contained alone, it is necessary to set the Mn content at Mn ≧0.8% by weight.

In examples (6), (7), (9) and (11) to (13) in which the Mn content was smaller than 0.8% by weight, but Mn≧0.6% by weight and Mn+Ni+Ti≧0.8%by weight, no crack was generated, whereas in comparative examples (9a) and (10a) in which Mn+Ni+Ti≧0.8% by weight and yet, the Mn content is smaller than 0.6% by weight, cracks were generated. In this way, it can be seen that when nickel (Ni) and/or titanium (Ti) were contained in addition to manganese (Mn), the Mn content must be equal to or larger than 0.6% by weight and the Mn+Ni+Ti content must be equal to or larger than 0.8% by weight.

Figure 15:
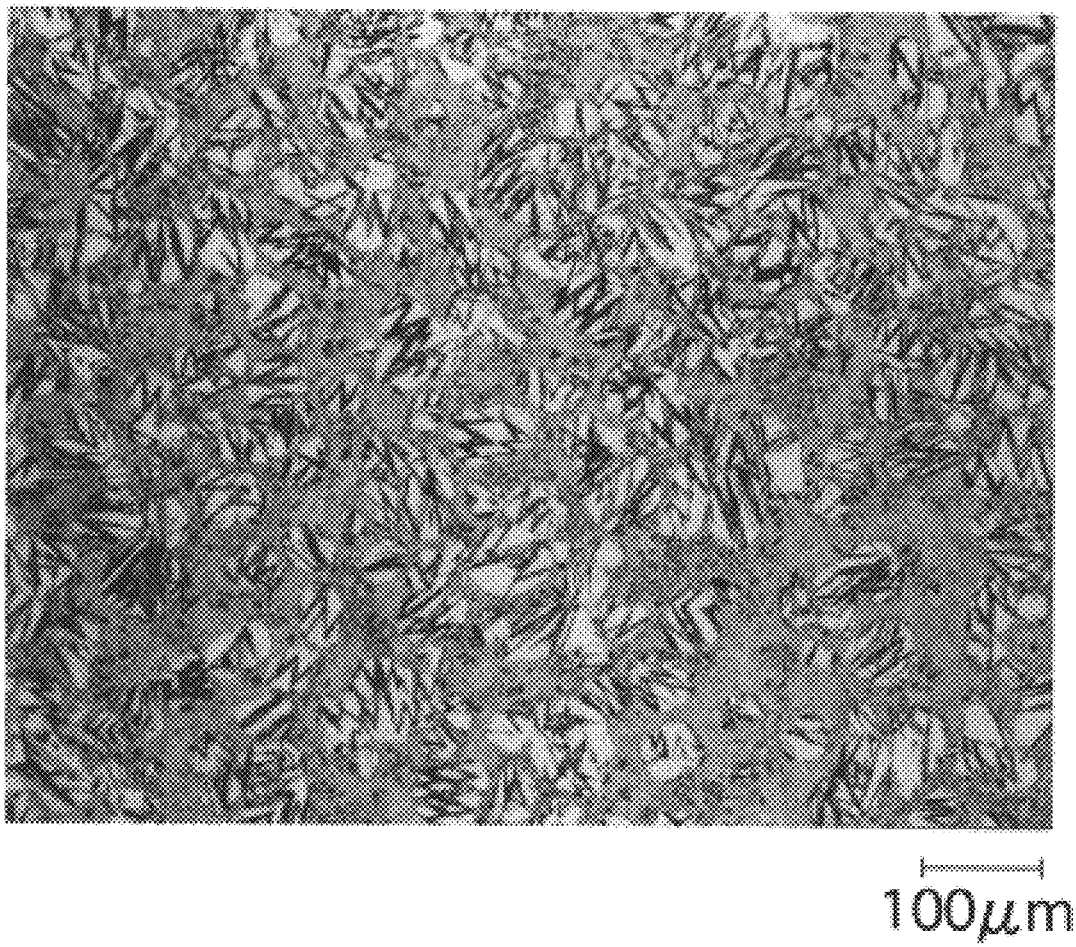
FIG. 15 is a photomicrograph of the texture showing the first example of a metallographic structure of the oil pump cover.

FIG. 15 is a photomicrograph of the texture showing the metallographic structure of example (10) of the oil pump cover. In FIG. 15, a black needle-shaped portion is martensite, a light gray portion adjacent the black needle-shaped portion is austenite. The portion of the mixed structure comprising martensite and austenite is a portion which was a solid phase in the casting. A dark gray portion around the portion which was the solid phase is ledeburite comprising a eutectic crystal of austenite and cementite, and is a portion which was a liquid phase in the casting.

Figure 16:
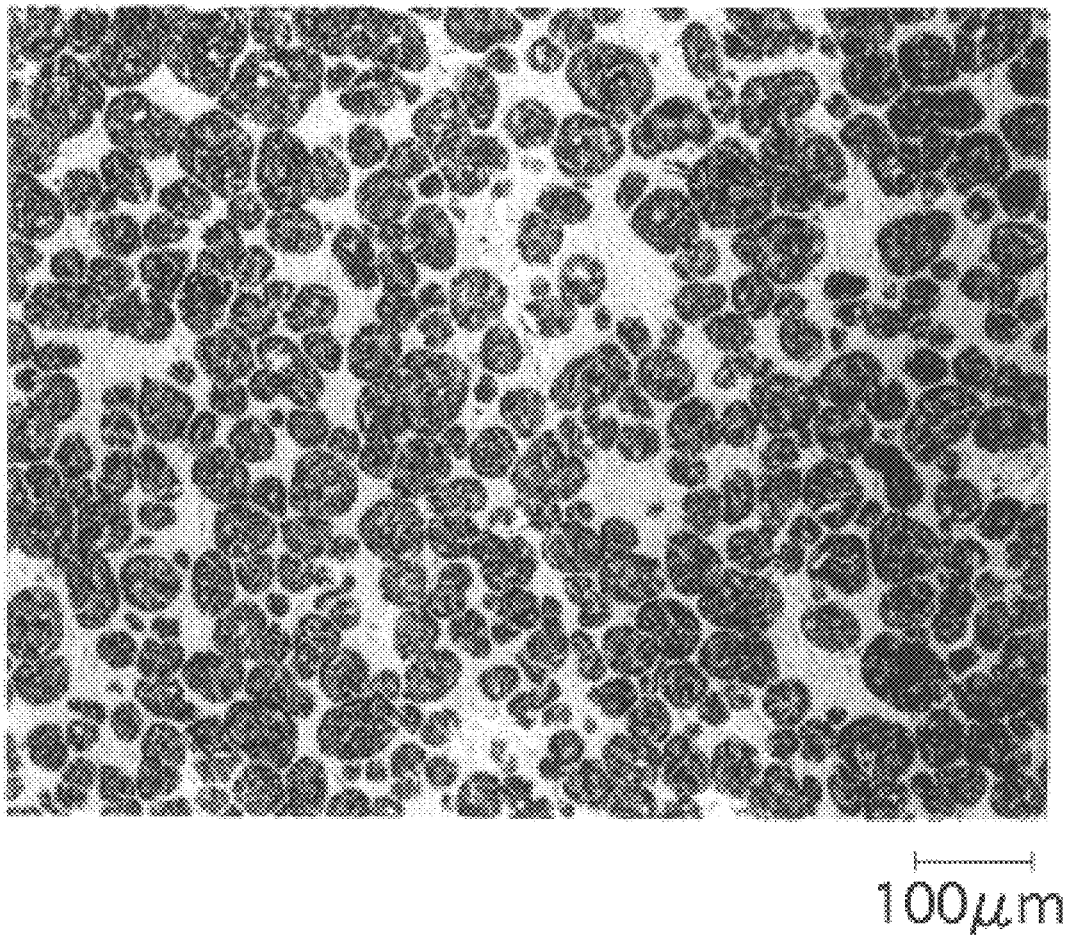
FIG. 16 is a photomicrograph of the texture showing the second example of a metallographic structure of the oil pump cover.

FIG. 16 is a photomicrograph of the texture showing the metallographic structure of example (6a) of the oil pump cover. In FIG. 16, a black portion is a portion which was a solid phase in the above-described casting, and such black portion has a pearlite structure. A dark gray portion around the portion which was the solid phase is ledeburite comprising a eutectic crystal of austenite and cementite, and is a portion which was a liquid phase in the casting. As can be seen from comparison of FIGS. 15 and 16 with each other, in example (10), austenite exists in the portion which was the solid phase and hence, the entire example (10) includes a large amount of austenite and has an excellent toughness.

Embodiment III

A. Heating Test

Figure 17:
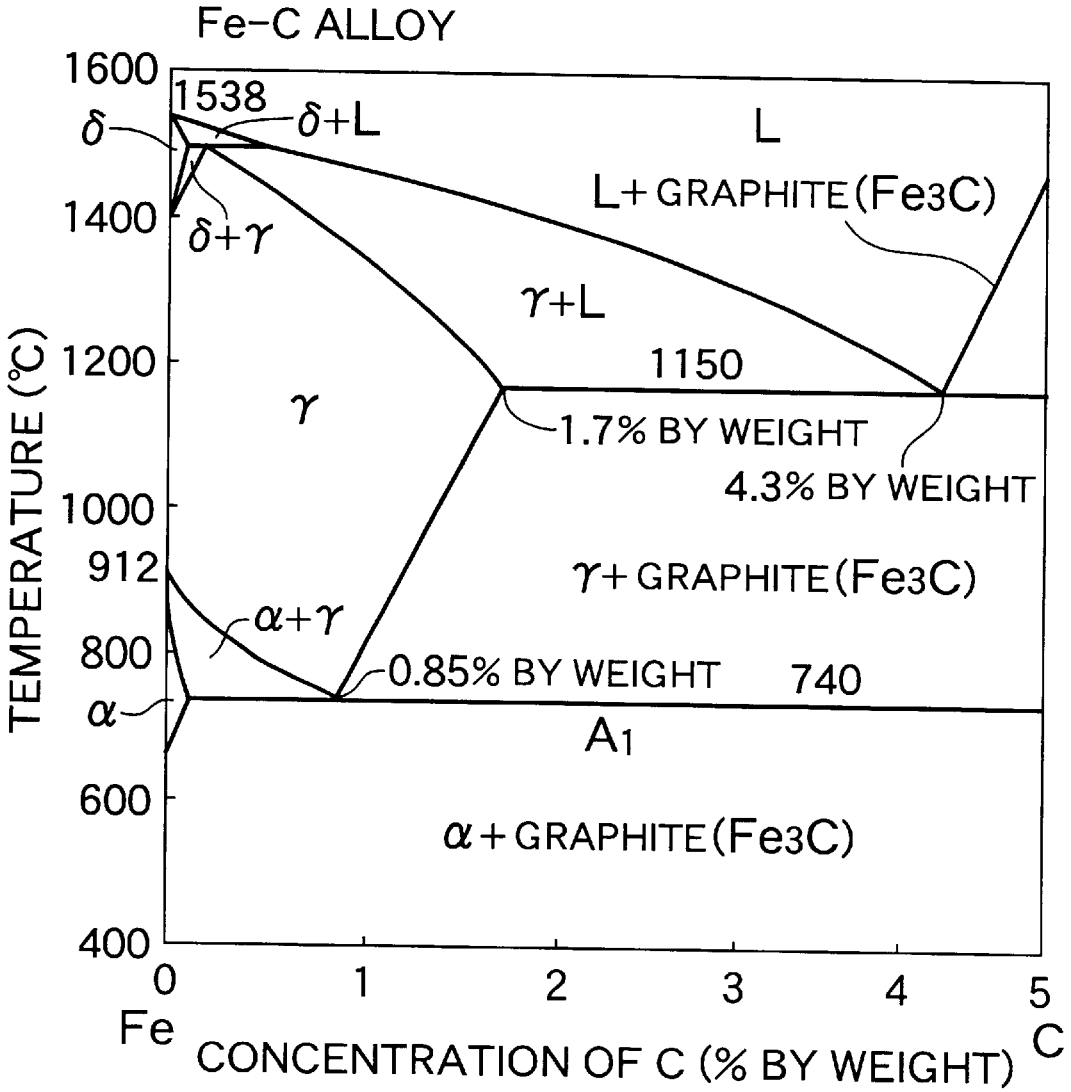
FIG. 17 is an Fe—C based equilibrium diagram.

An Fe—C (2% by weight) alloy material was selected as the Fe-based alloy material. FIG. 17 is an Fe—C based equilibrium diagram, wherein a point $A_1$ of the Fe—C (2% by weight) alloy material is 740° C.

Figure 18:
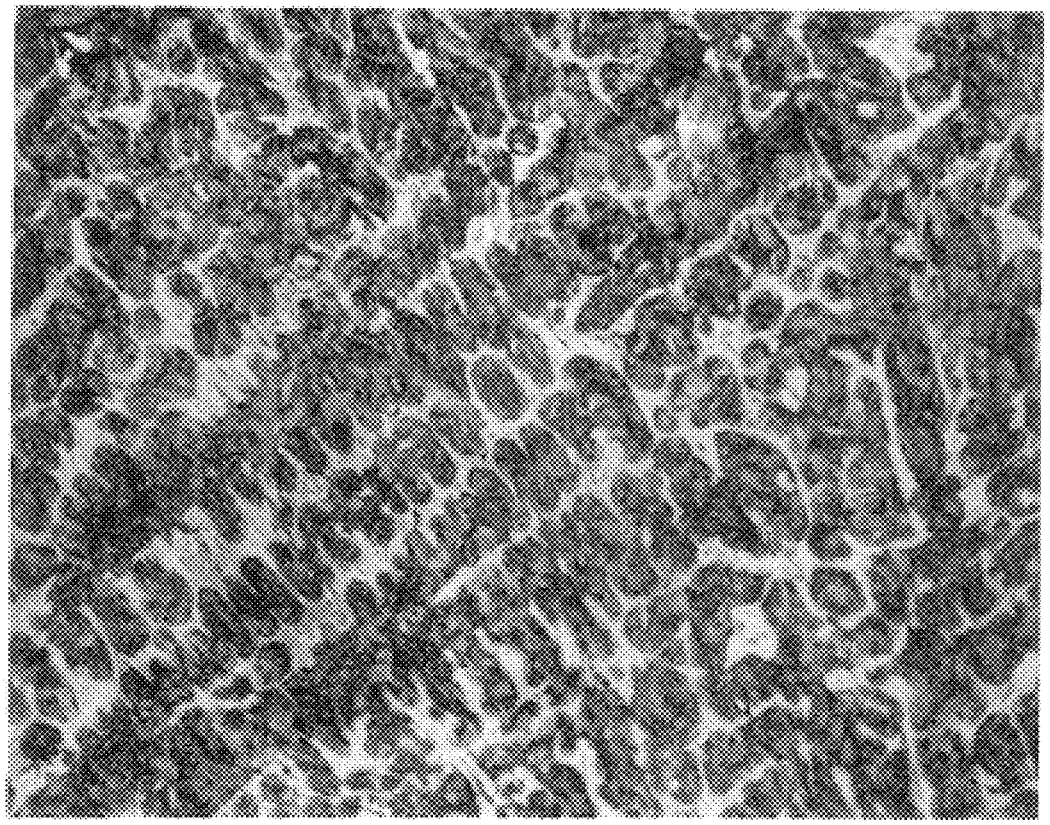
FIG. 18 is a photomicrograph of the texture showing the metallographic structure of an Fe-based alloy material having a chilled structure.
Figure 19:
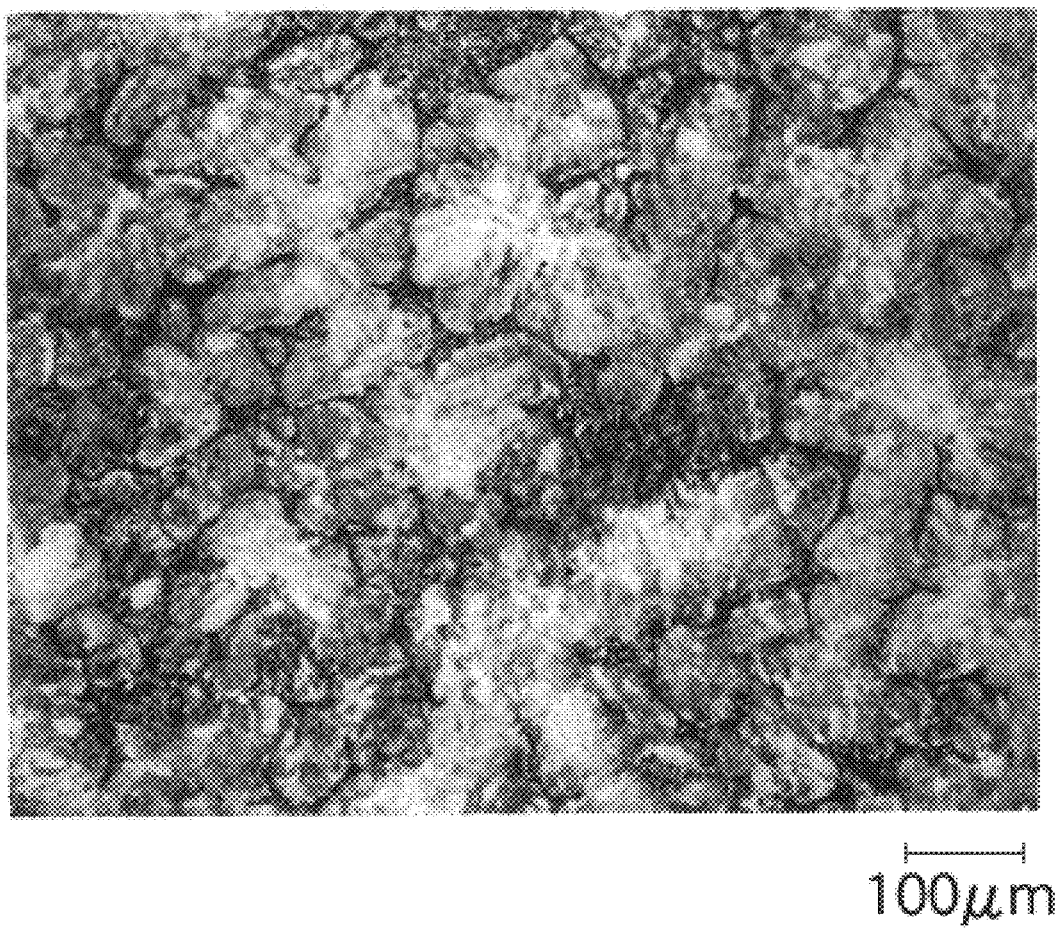
FIG. 19 is a photomicrograph of the texture showing the metallographic structure of an Fe-based alloy material having no chilled structure.

FIG. 18 shows the photomicrographic structure of a material having such composition and produced by a continuous casting process, namely, a continuously-cast material, wherein it can be seen that this metallographic structure is a mixed structure comprising dendrite and a chilled structure (a white portion). FIG. 19 shows the photomicrographic structure of a material having such composition and produced by casting using a die, namely, a die-cast material, wherein it can be seen that this metallographic structure is a structure having a graphite phase precipitated in dendrite.

Figure 20:
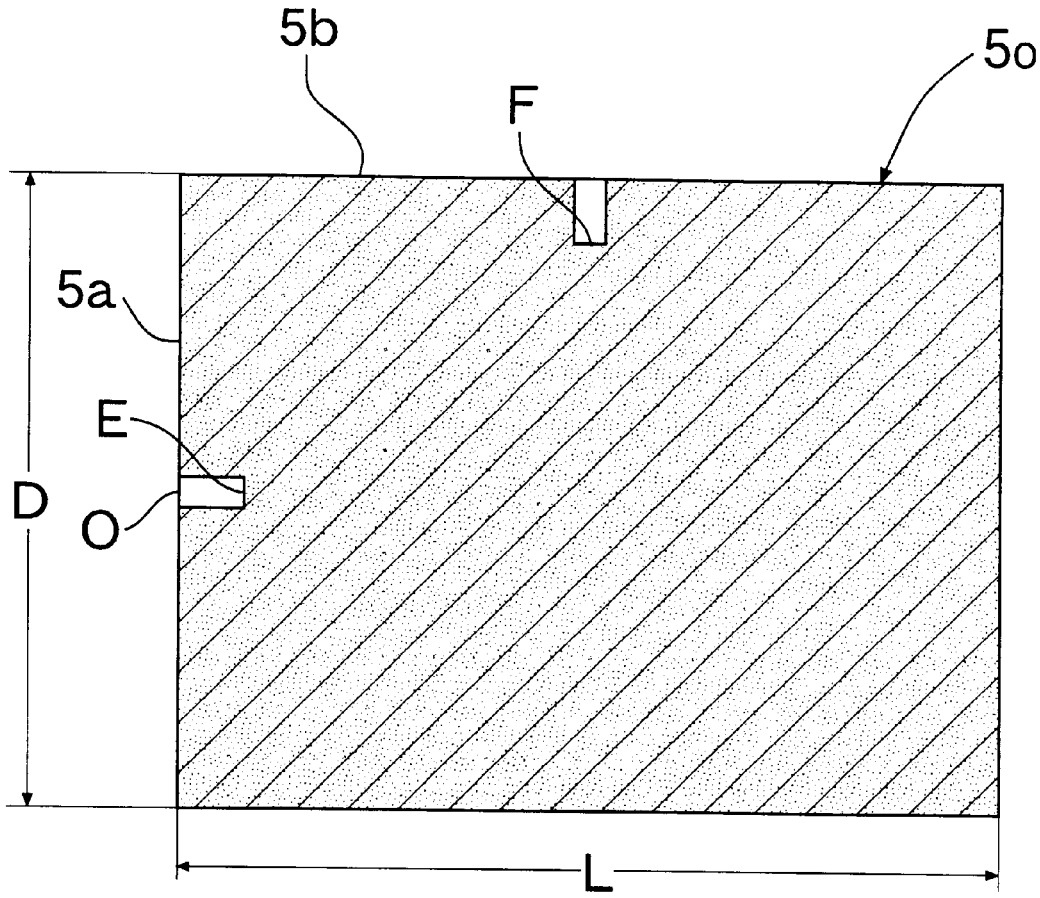
FIG. 20 is a sectional view of the Fe-based alloy material.

Then, a columnar Fe-based alloy material $\mathbf{5}_0$ having a diameter D of 50 mm and a length L of 65 mm as shown in FIG. 20 was fabricated from the continuously-cast material, and thermocouples were embedded into one 5a of end surfaces and an outer peripheral surface 5b of the material $\mathbf{5}_0$, respectively. The position of the thermocouple in the end surface 5*a* is a point E at a depth of 5 mm from the center O of the end surface, while the position of the thermocouple in the outer peripheral surface 5*b* is a point F at a depth of 5 mm from a bisected position in the direction of a generating line. During heating of the material $\mathbf{5}_0$, the temperature of the point E is lowest, and this temperature is a criterion in the casting process. Therefore, the point E is defined as a casting reference-temperature point. The point F is a site which is heated to the highest temperature in the induction heating and hence, the point F is defined as the highest-temperature point.

Figure 21:
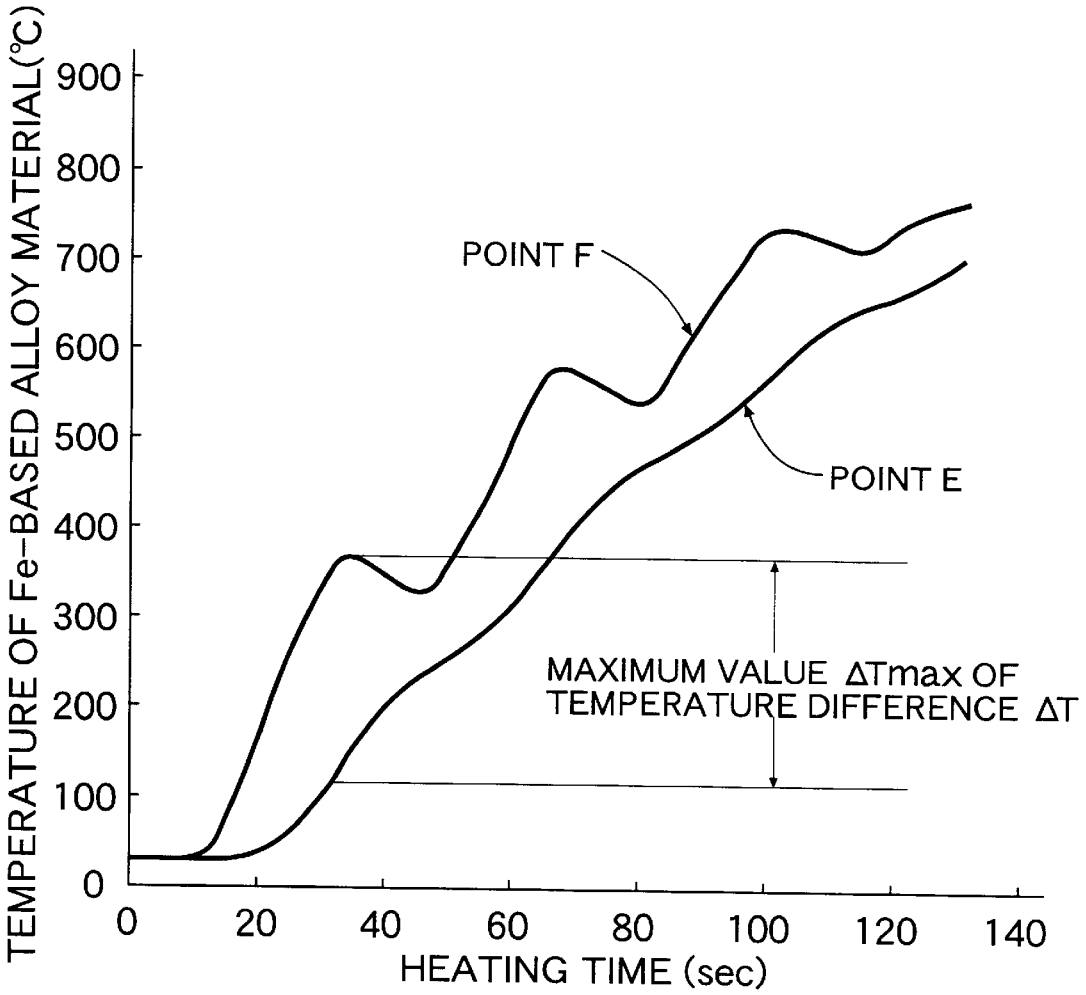
FIG. 21 is a graph showing the relationship between the heating time and the temperature of the Fe-based alloy material.

FIG. 21 shows one example of a temperature rise curve provided when the Fe-based alloy material $\mathbf{5}_0$ was subject to an induction heating. In the induction heating, the heating rate is controlled by an on-off control and hence, in the highest-temperature point F intensively influenced by the turning-on/off, the temperature is lowered slightly at the off-time, but in the casting reference-temperature point E, the temperature is raised substantially rectilinearly, because the point E is less influenced by the turning-on/off. However, the heating rate at the highest-temperature point F is larger than that at the casting reference-temperature point E.

Therefore, the average value $(H_RE+H_RF)/2$ of the heating rates $H_RE$ and $H_RF$ at the points E and F is defined as the average heating rate $H_R$, and the maximum temperature gradient $T_G$ is defined as being equal to $\Delta T_{max}/d$ (° C./mm) from the maximum value $\Delta T_{max}$ of the difference $\Delta T$ between the temperatures at the points E and F and the distance d between both the points E and F. The relationship between the average value $(H_RE+H_RF)$ as well as the maximum temperature gradient $T_G$ and the cracking due to the heating of the Fe-based alloy material $\mathbf{5}_0$ was examined.

Figure 22:
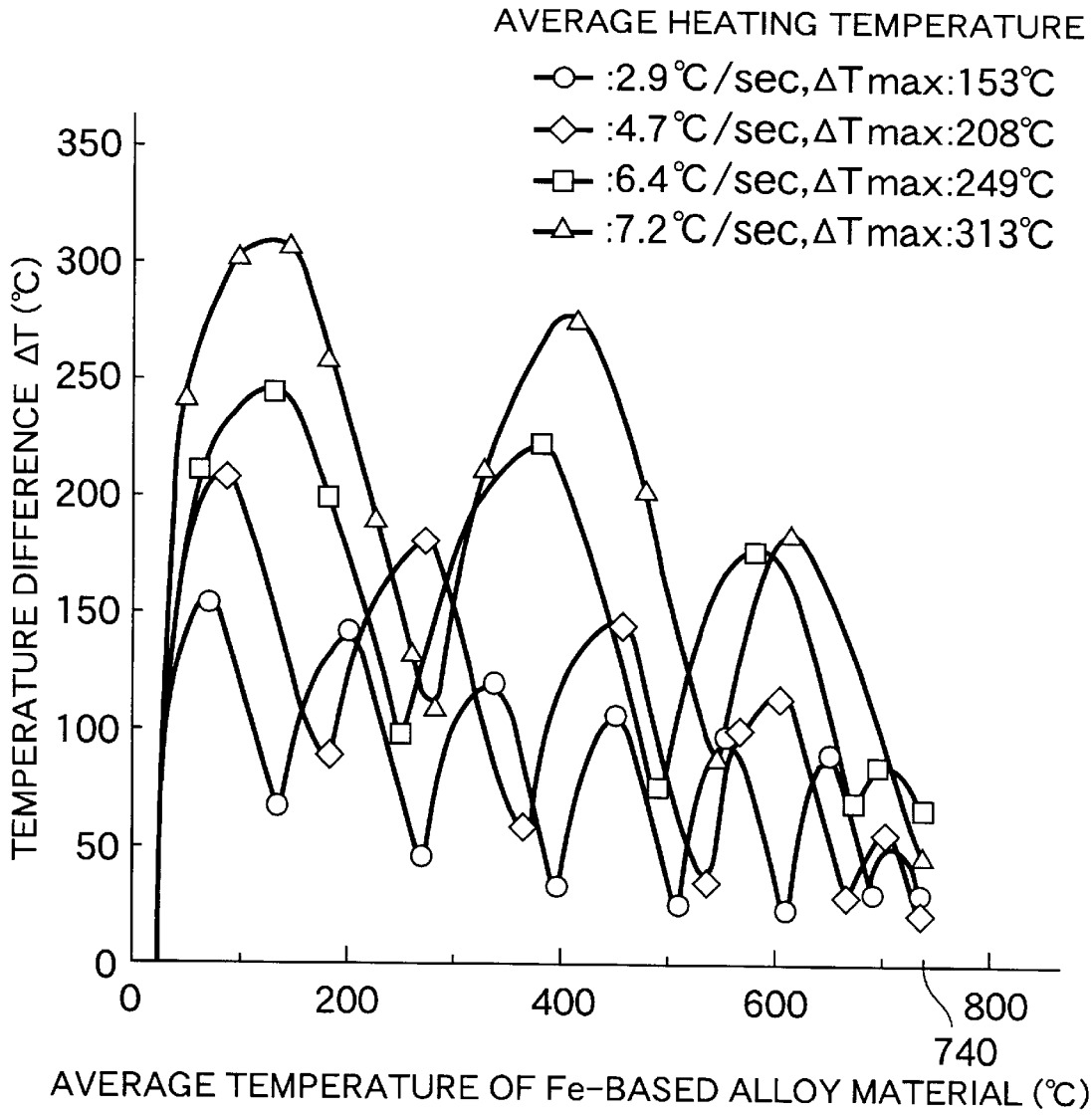
FIG. 22 is a graph showing the relationship between the average temperature of the Fe-based alloy material having the chilled structure and the temperature difference.
Figure 23:
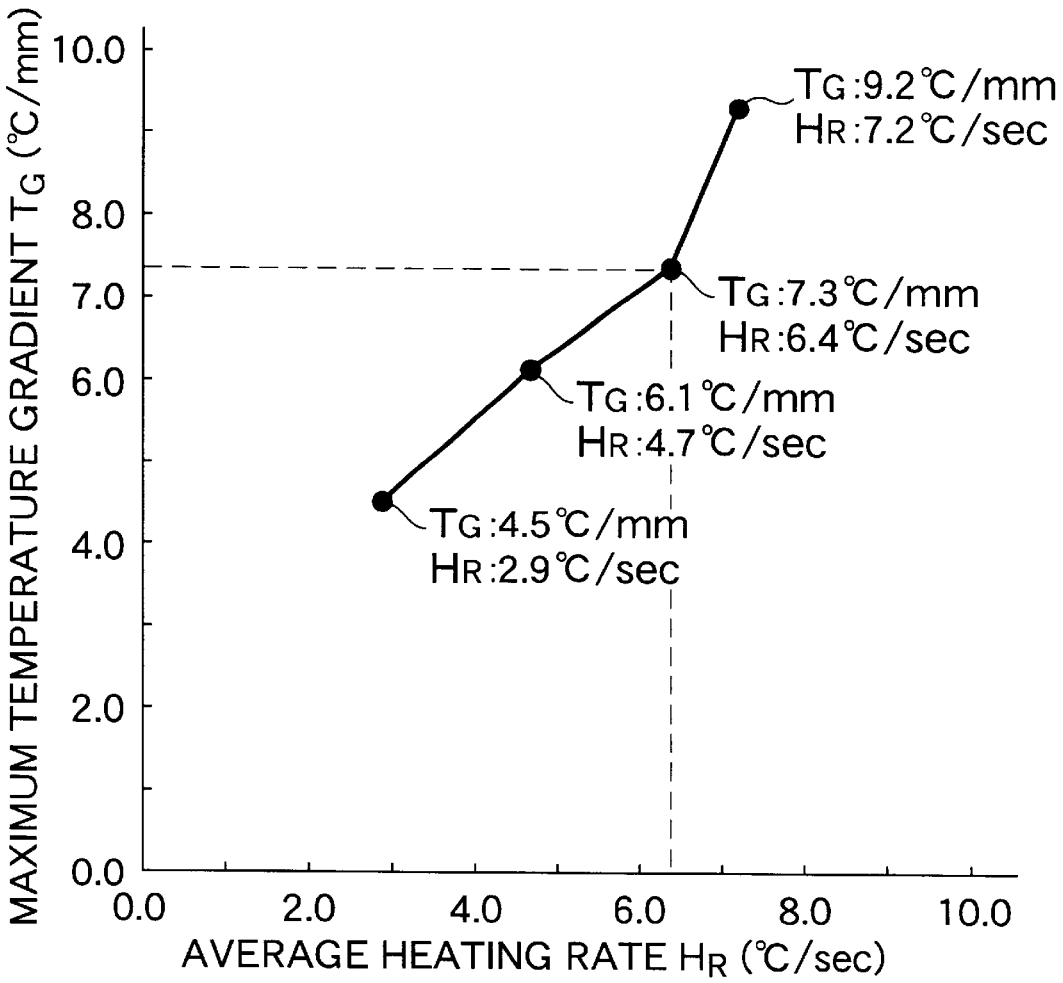
FIG. 23 is a graph showing the relationship between the average heating rate and the maximum temperature gradient.

The Fe-based alloy material $\mathbf{5}_0$ was heated to 740° C. (the point $A_1$) at the average heating rate $H_R$ set at 2.9° C./sec, 4.7° C./sec, 6.4° C./sec and 7.2° C./sec. The relationship between the average temperature of the material $\mathbf{5}_0$ and the difference AT between the temperatures at the casting reference-temperature point P and the highest-temperature point Q was examined, thereby providing a result shown in FIG. 22. The term "average temperature" as used herein means an average value $(T_E+T_F)/2$ of temperatures $T_E$ and $T_F$ at the points E and F. The maximum temperature gradient $T_G$ was calculated from a maximum value of the temperature differences $\Delta T$ and the distance d≈34 mm between both the points E and F. The relationship between the maximum temperature gradient $T_G$ and the average heating temperature $H_R$ was examined, thereby providing a result shown in FIG. 23. When the average heating temperature $H_R$ was set at 4.7° C./sec in this heating test, cracks were not generated in the Fe-based alloy material, but when the average heating rate $H_R$ was set at 6.4° C./sec, cracks were generated in the Fe-based alloy material.

From such results, in the present invention, the average heating rate $H_R$ to the point $A_1$ is set at $H_R$ s 6.0° C./sec, and the maximum temperature gradient $T_G$ of the inside of the material per unit distance is set at $T_G \leqq 7°$ C./mm.

Figure 24:
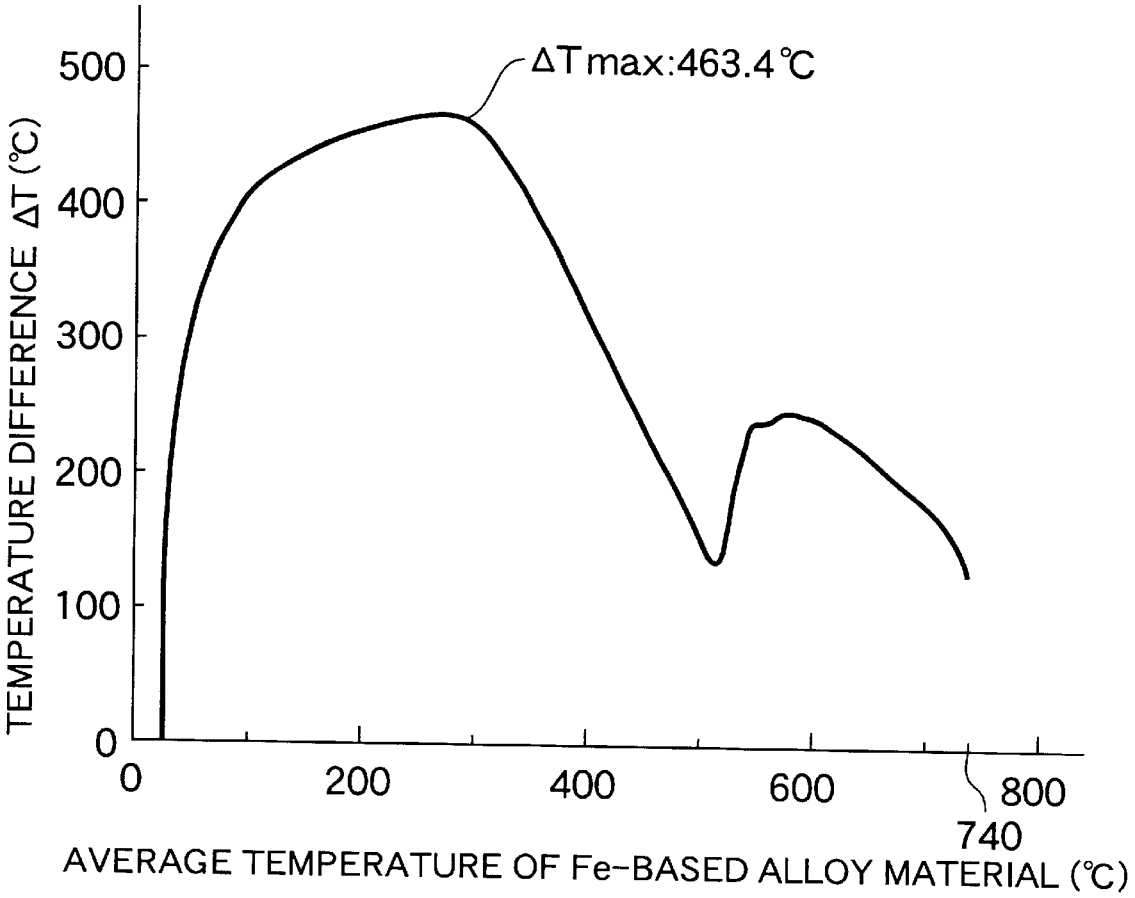
FIG. 24 is a graph showing the relationship between the average temperature of the Fe-based alloy material having no chilled structure and the temperature difference.

Then, for comparison, an Fe-based alloy material fabricated from the die-cast material was heated to 740° C. (the point $A_1$) at an average heating rate set at 11.74° C./sec, and the relationship between the average temperature of the material and the difference $\Delta T$ between the temperatures at the casting reference-temperature point E and the highest-temperature point F was examined, thereby providing a result shown in FIG. 24. In this case, the maximum value $\Delta T_{max}$ of the temperature differences $\Delta T$ was 463.4° C. and hence, the maximum temperature gradient $T_G$ was 13.6° C., but cracks were not generated in the material. This is attributable to the absence of a chilled structure in the material.

B. Ultrasonic Velocity Measuring Test

Examples 1 to 4 of test pieces as shown in Table 7 were fabricated from the continuously-cast material and the die-cast material made of an Fe—C (2% by weight) alloy. Each of examples 1 to 4 was of a disk shape having a diameter of 50 mm and a thickness of 30 mm. Examples 1 to 4 were subjected to the ultrasonic velocity measurement. EGT1K made by Kusaka Rare Metal Co., was used as an ultrasonic measuring apparatus, and the measurement of the sonic velocity was carried out two times for each of examples 1 to 4 in a state in which a probe of the ultrasonic measuring apparatus was placed against the outer peripheral surface, the center of an end surface and a point of the end surface corresponding to one half of its radius. Results are shown in Table 7.

TABLE 7

| Test piece | Material | Measuring position | Sonic velocity Sv (mm/sec) Outer periph-eral surface | Center of end surface | One half of radius |
|---|---|---|---|---|---|
| Example 1 | Continuously-cast material Chilled structure: presence | Measured value | 5887 | 5891 | 5872 |
| | | | 5872 | 5888 | 5880 |
| | | Average value | 5880 | 5890 | 5876 |
| | | Total average value | 5882 | | |
| Example 2 | Mold-cast material Chilled structure: presence | Measured value | 5861 | 5869 | 5862 |
| | | | 5856 | 5820 | 5850 |
| | | Average value | 5859 | 5845 | 5856 |
| | | Total average value | 5853 | | |
| Example 3 | Mold-cast material Chilled structure: absence Long flake-formed graphite: presence | Measured value | 5267 | 5132 | 5197 |
| | | | 5269 | 5123 | 5198 |
| | | Average value | 5268 | 5128 | 5198 |
| | | Total average value | 5198 | | |
| Example 4 | Mold-cast material Chilled structure: absence Short flake-formed graphite: presence | Measured value | 5457 | 5280 | 5396 |
| | | | 5458 | 5314 | 5401 |
| | | Average value | 5458 | 5297 | 5399 |
| | | Total average value | 5384 | | |

Figure 25:
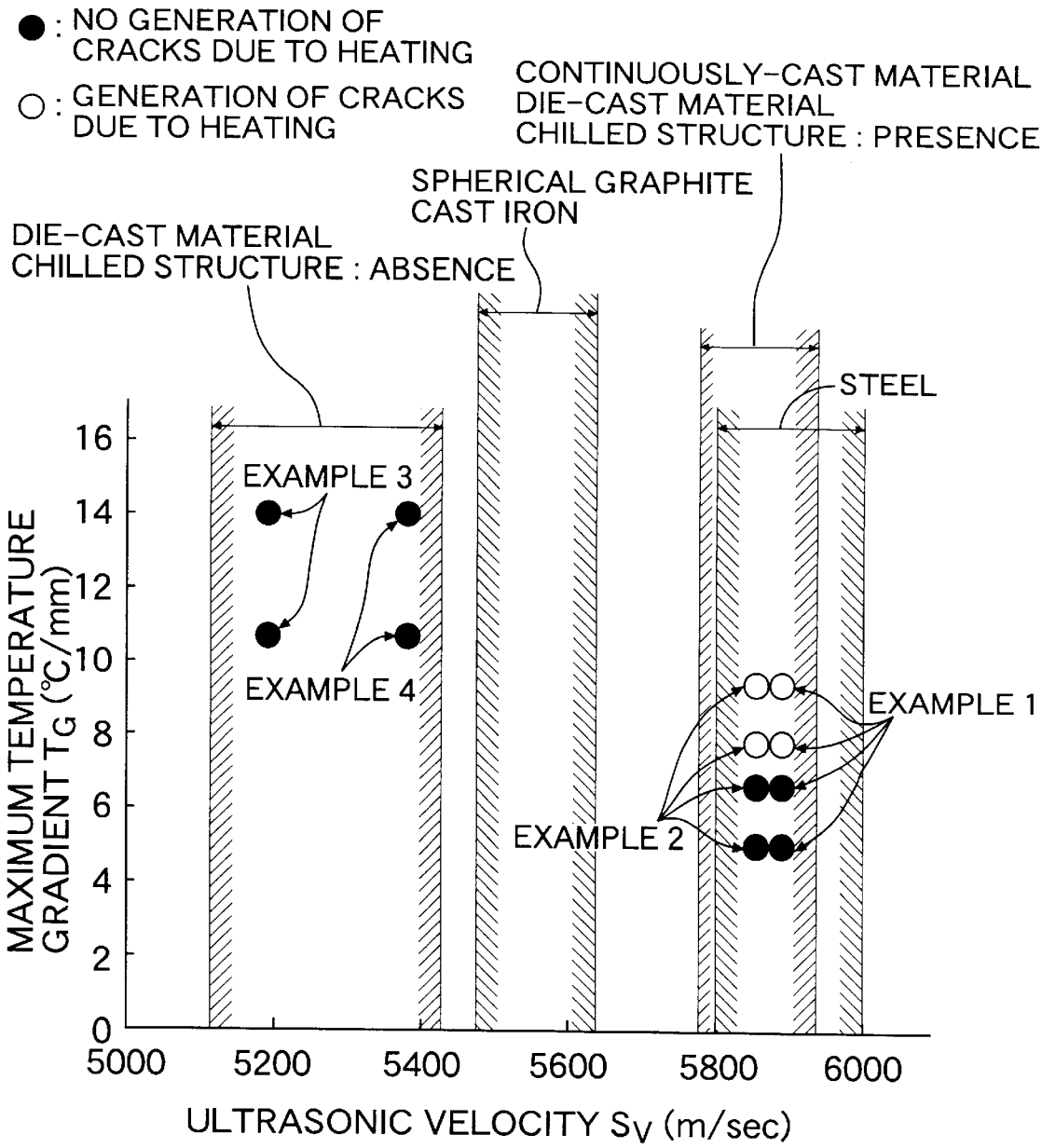
FIG. 25 is a graph showing the relationship between the ultrasonic velocity and the maximum temperature gradient.

Then, each of examples 1 to 4 was subjected to a heating test at various maximum temperature gradients $T_G$, whereby it was observed whether cracks were generated, thereby providing a result shown in FIG. 25. The sonic velocities for a spherical graphite cast iron and a steel are also shown in FIG. 25. As is apparent from FIG. 25, it can be seen that the ultrasonic velocity measurement is an effective means for determining whether the material has a chilled structure, because the sonic velocity for examples 1 and 2 having the chilled structure is remarkably high, as compared with examples 3 and 4 having no chilled structure and an FCD material. It was confirmed that cracks was generated due to the heating at the temperature gradient $T_G$ equal to or higher than 7° C./mm in examples 1 and 2 having the sonic velocity Sv equal to or higher than 5,600 m/sec.

C. Casting Test

Example 1 shown in Table 7 was heated to the point $A_1$ at an average heating rate $H_R$ equal to 2.9° C./sec and a maximum temperature gradient $T_G$ equal to 4.5° C./mm, and example 2 was heated to the point $A_1$ at an average heating rate $H_R$ equal to 4.7° C./sec and a maximum temperature gradient $T_G$ equal to 6.1° C./mm. Subsequently, they were heated to about 1,200° C. into their semi-molten states. Then, examples 1 and 2 in the semi-molten states were placed into a pressure casting apparatus 1 shown in FIG. 1, where they were subjected to a casting process. The resulting cast products were examined and as a result, it was made clear that they were free of defects such as the coalescence of crystal grains and had a good quality.

This embodiment is not limited to the Fe—C based alloy material, and is also applicable to the other Fe-based alloy materials such as an Fe—C—Si (1% by weight) alloy material (point $A_1$: 758° C.), an Fe—C—Si (2% by weight) alloy material (point $A_1$: 780° C.), an Fe—C—Si (3% by weight) alloy material (point $A_1$: 820° C.), and the like.

What is claimed is:

1. A thixocast Fe-based alloy material comprising 1.8% by weight≦C≦2.5% by weight 1.0% by weight≦Si≦3.0% by weight 0.1% by weight≦Mn≦1.5% by weight 0.5% by weight≦Ni≦3.0% by weight, and as the balance, iron (Fe) including inevitable impurities, wherein an amount Ec of eutectic crystal consisting of Fe and C is in a range of 10% by weight<Ec<50% by weight.

2. A thixocast Fe-based alloy material comprising 1.8% by weight≦C≦2.5% by weight 1.0% by weight≦Si≦3.0% by weight 0.8% by weight≦Mn≦1.5% by weight, and as the balance, iron (Fe) including inevitable impurities, wherein an amount Ec of eutectic crystal consisting of Fe and C is in a range of 10% by weight<Ec<50% by weight.

3. A thixocast Fe-based alloy material, comprising carbon (C) of a content in a range of 1.8% by weight≦C≦2.5% by weight, silicon (Si) of a content in a range of 1.0% by weight≦Si≦3.0% by weight, manganese (Mn) of a content in a range of 0.6% by weight≦Mn≦1.5% by weight, at least one of nickel (Ni) of a content in a range of 0.2% by weight≦Ni≦3.0% by weight and titanium (Ti) of a content in a range of 0.05% by weight≦Ti≦0.6% by weight, the total sum of the Mn content, the Ni content and the Ti content being equal to or larger than 0.8% by weight (Mn+Ni+Ti≧0.8% by weight), and the balance being iron (Fe) including inevitable impurities, wherein an amount of eutectic crystal consisting of Fe and C is in a range of 10% by weight<Ec<50% by weight.

4. A thixocast Fe-based alloy material according to claim 1, 2 or 3, wherein a solid phase rate R in a semi-molten state is set at R>50%.

* * * * *